US007586462B1

(12) United States Patent
Tetorka

(10) Patent No.: US 7,586,462 B1
(45) Date of Patent: Sep. 8, 2009

(54) PHYSICALLY SMALL SPIRAL ANTENNA

(75) Inventor: Stephen Gregory Tetorka, Fair Haven, NJ (US)

(73) Assignee: Stephen G. Tetorka, Fair Haven, NJ (US)

( * ) Notice: Subject to any disclaimer, the term of this patent is extended or adjusted under 35 U.S.C. 154(b) by 0 days.

(21) Appl. No.: 12/008,075

(22) Filed: Jan. 8, 2008

Related U.S. Application Data

(60) Provisional application No. 60/898,158, filed on Jan. 29, 2007.

(51) Int. Cl.
*H01Q 1/36* (2006.01)
*H01Q 19/10* (2006.01)

(52) U.S. Cl. ..... 343/895; 343/818

(58) Field of Classification Search ..... 343/793–823, 343/895

See application file for complete search history.

(56) References Cited

U.S. PATENT DOCUMENTS

| | | | | | |
|---|---|---|---|---|---|
| 3,432,858 | A * | 3/1969 | Brown | 343/752 |
| 3,454,951 | A | 7/1969 | Patterson | |
| 3,562,756 | A | 2/1971 | Kuo | |
| 3,633,210 | A | 1/1972 | Westerman | |
| 3,858,220 | A * | 12/1974 | Arnow | 343/802 |
| 3,949,407 | A | 4/1976 | Jagdmann | |
| 4,243,993 | A | 1/1981 | Lamberty | |
| 4,525,720 | A | 6/1985 | Corzine | |
| 4,725,848 | A | 2/1988 | Honda | |
| 5,257,032 | A * | 10/1993 | Diamond et al. | 343/730 |
| 5,457,469 | A | 10/1995 | Diamond | |
| 6,714,120 | B2 * | 3/2004 | Blama et al. | 340/10.1 |
| 6,914,576 | B1 * | 7/2005 | Sahba | 343/793 |
| 2003/0006938 | A1 * | 1/2003 | Nesic et al. | 343/795 |
| 2003/0156065 | A1 * | 8/2003 | Jo et al. | 343/700 MS |
| 2006/0038725 | A1 * | 2/2006 | Tikhov et al. | 343/700 MS |
| 2008/0272980 | A1 * | 11/2008 | Adel et al. | 343/895 |

OTHER PUBLICATIONS

Petlowany, Bill; Wires and Pliers From out of the past—antennas with a new twist. WorldRadio Mar. 1998 p. 43-45.*
Caldwell, William; Wires and Pliers Variotions on a "Petlowany"; WordlRadio Jun. 1999, p. 50-51.*
Allan Brown, An Eighteen Inch Dipole on Fifteen Meters, 73 Magazine, Feb. 1970 pp. 24-28—Best Available Copy.
Bill Petlowany, From Out of the Past—Antennas With a New Twist, WorldRadio, Mar. 1996 2120 28th St., Sacramento Calif. p. 43-45.
William Caldwell, Variations on a Petlowany, WorldRadio, Jun. 1999, pp. 50-51, 2120 28th St. Sacramento, Calif.

* cited by examiner

*Primary Examiner*—Rexford N Barnie
*Assistant Examiner*—Dylan White

(57) ABSTRACT

An improved dipole antenna having unbalanced radio frequency current in spiral radiating elements operating on a plurality of resonant frequencies providing a wide range of impedance matching to a device feeding radio frequency energy to said antenna. Said dipole antenna is also configured with parasitic spiral elements to provide increased operational performance. Each said spiral radiating element electrical parameter enabling said element to be operated alone. Said dipole antenna operates on any portion of the radio frequency spectrum.

20 Claims, 18 Drawing Sheets

Fig 1C
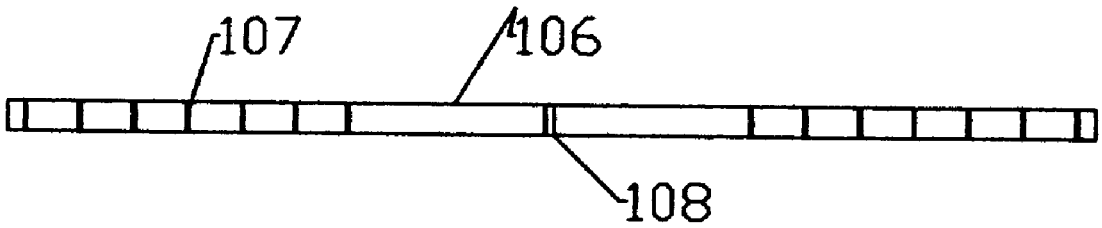
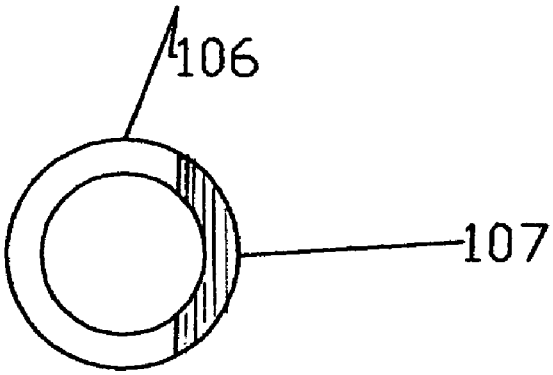
Fig 1D

109

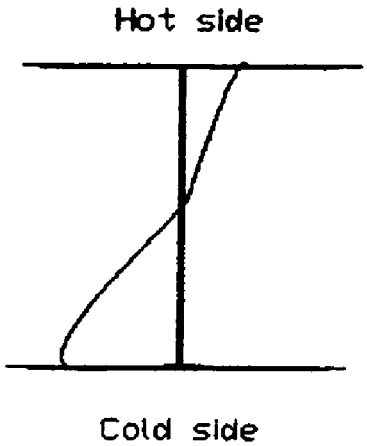
S8
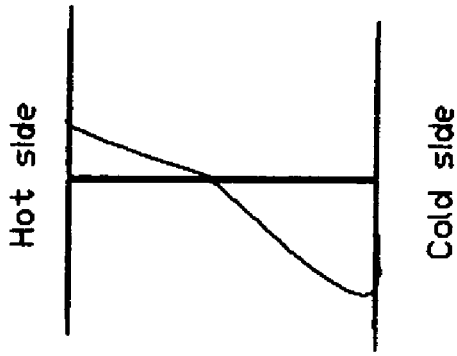
S5
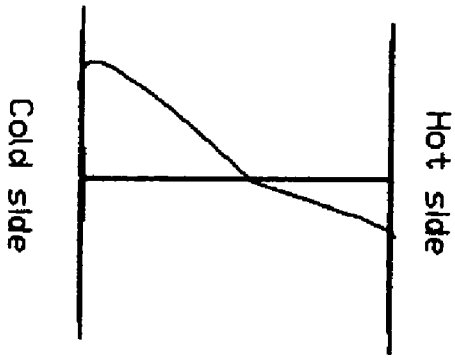
S6
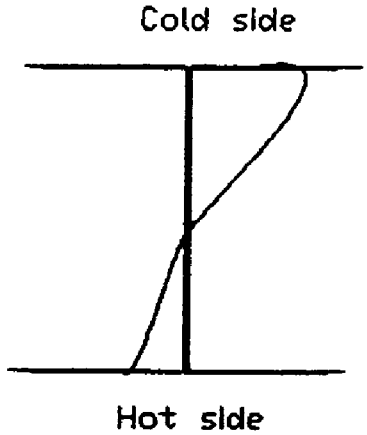
S4
Fig 10

PHYSICALLY SMALL SPIRAL ANTENNA

CROSS-REFERENCE TO RELATED APPLICATIONS

This application claims the benefit of provisional patent application Ser. No. US60/898,158 filed Jan. 29, 2007 by the present inventor.

FEDERALLY SPONSORED RESEARCH

Not Applicable

SEQUENCE LISTING OR PROGRAM

Not Applicable

BACKGROUND OF THE INVENTION

1. Field of Invention

This invention relates to dipole antennas used for receiving and transmitting radio frequency energy.

2. Prior Art

There is a long history of man's attempt to create antennas that are small and compact in size with performance equal to those antennas of significantly larger dimension. The driving forces behind this movement are the wish for convenience and low cost. A good example of such small and compact spiral antenna is that one called the "spider web." This antenna was used in the early days of radio for the reception of AM broadcast in the home; it was made from wires placed onto a wood frame in a spiral fashion. This antenna most often was placed on top of or alongside the AM radio which was housed inside a beautifully finished wood cabinet.

The science of antennas continues to move forward thanks to the use of sophisticated test instrumentation not available to our predecessors. The development in material science has made concomitant advancement. Man continues to learn and makes improvements in old designs—this is called Progress.

I submit this Patent Application on the improvement of the resonant and balanced dipole antenna prior art as submitted by Brown—U.S. Pat. No. 3,432,858 dated Mar. 11, 1969 regarding his Short Dipole Antenna. Reference will be made to others who experimented with similar devices but did not achieve the goal and performance that I have.

Dipole antennas are primarily designed to have balanced radio frequency (RF) antenna current at resonance at a primary frequency. The antenna described in this patent has unbalanced RF antenna current and has a plurality of resonant frequencies. This antenna has merits of utility, notable performance advantages and useful benefits not previously exploited with dipole antennas. Additionally, this resonant and unbalanced antenna has efficient and effective performance even though this it is uniquely smaller in physical size than those customarily used on the same operating frequency.

The primary objective of Mr. Brown was to create a short dipole antenna that had radiating elements placed perpendicular to the ground; such antenna is called a vertical dipole due to its physical orientation. He asserts—per specification lines 2-47 to 52—that the optimum height above ground for his invention is ⅜ (0.375) wavelength in order to achieve maximum distance for reception or transmission. There is no optimum height needed for my invention; my antenna operates with good performance as low as 0.037 wavelength distance from the ground with both vertical and horizontal orientation.

Mr. Brown's invention—as per lines 2-60 and 61 is "tuned to receive signals efficiently at two relatively widely spaced operating frequencies." My invention both receives and transmits efficiently at many frequencies—closely or widely spaced—and at any number of frequencies combinations as selected by the user.

Mr. Brown's invention requires—per line 4-45—"in actual practice" the use of a loading device "56 or 58" to resonant his antenna so that "it appears as a resistive load for the transmission line"—lines 4-50 and 51. My antenna needs no such supplementary devices or components for loading, impedance matching or to achieve resonance in order to appear as a resistive load for the transmission line.

Of vital importance to the reader is that Mr. Brown asserts that his end spirals elements are for tuning purposes and that the radiating portion of his antenna are the co-linear short metal segments placed between the transmission line and the end spiral wire elements—lines 2-11 to 19, 37 to 39. Indeed, he asserts that he wishes to "minimize radiation therefrom (sic. spirals) and to concentrate radiation of the antenna structure in the radiating elements (sic. co-linear short metal segments) themselves."—lines 2-43 to 45. According to his design, his spiral and radiating portion of the antenna "provide a balanced antenna"—lines 2-16 & 17. My antenna invention—operating on the reverse philosophy—uses the end spiral wire elements for maximum RF antenna radiation in an unbalanced state with any radiation from its co-linear short metal segments, that is the connecting wires, being minimal. The reader will thus notice two completely different phenomena when comparing Mr. Brown's antenna with my antenna invention.

Mr. Brown's antenna needs a special device in order to be fed with coax transmission line.—lines—specification lines 3-8 to 10 and FIG. 4. My antenna invention can be directly connected to coax transmission line without the need for any kind additional devices of any sort.

With regard to the points of electrical connection to each spiral, he asserts that "these points of connection are preferably in the same general areas of each spirally-wound coil to provide a completely balanced structure"—specification lines 4-68 to 71. The design of my invention is such that the points of electrical connection to each spiral are intentionally positioned at different locations which are widely spaced relative to each other and contribute to an unbalanced RF antenna current.

Mr. Brown's method of construction and choice of material is open to improvement. He makes no statement about the suitability of his antenna to outdoor weather exposure. My antenna is designed for long term outdoor exposure and extreme weather conditions.

Of critical importance is his "spiral support member" FIG. 1-28. Each support member retains the wire in place such that spiral geometry is achieved and, hopefully maintained in such geometry during extreme weather conditions. Yet he fails to specify the material composition of this most important item. Should it be made of metal, the notch FIG. 3-32 must have a width equal to the wire diameter in order to sit into rib FIG. 3-30. He fails to provide means to secure and retain the wire within the notch and thus it is most susceptible to coming out especially during high wind condition. Also, any water entrained in the notch will force the wire out of the notch when the water turns into ice as water expands upon freezing. Should Mr. Brown intend his notch 32 be made from plastic, he fails to specify the type of polymer.

The polymer formulation is extremely important as it must be resistant to Ultraviolet degradation and not fail due to repeated stress from expansion and contraction during hot and cold temperature cycling. A polymer, that is plastic, is most susceptible to degradation when exposed to outdoor elements.

Mr. Brown's invention employs a "pinch-clip" connector FIG. 1-30. He does not specify the material for this important item. It must be a metal alloy for electrical conduction as his spiral conductor is metal wire. He should have specified the metal alloy for his clip as any combination of dissimilar metals will undergo galvanic reaction and deteriorate in a short period time and cause electrical catastrophic failure of this critical connection. Using the same metal for his clip as the spiral wire will still deteriorate electrical conductance due to oxidation. Also, a pinch-clip connector is susceptible to dislocation from loosening of clamping pressure due to weathering and temperature cycling from metal expansion and contraction. The points of electrical connection to the spiral elements in my invention are soldered for permanence.

Mr. Brown wishes his antenna "to provide a balanced antenna structure"—lines 2-16 & 17. It is of utmost importance for the reader to discern that Mr. Brown does not claim the benefits of an antenna using an unbalance structure. Indeed, prior art appears oblivious to the many useful benefits obtained when the antenna RF current is in an unbalanced state!

Mr. Brown's invention is able to receive "two widely spaced frequency bands"—lines 5-52 & 53. He specifically cites both the 10 meter and 40 meter amateur bands. The centers of these two bands are 28.85 MHz and 7.15 MHz respectively; thus his wide spacing is 28.85/7.15=4.03 multiplying factor. He does not purport nor state that two widely spaced frequency bands can be transmitted on. Nor does he present his invention capable of receiving or transmitting on two closely spaced frequencies. My antenna improvements permit both receiving and transmitting on two or more frequencies whether they are widely or closely spaced.

On February 1970, Mr. Brown wrote an article for 73 *Magazine* which was devoted to ham radio enthusiasts. His article "An Eighteen Inch Dipole on Fifteen Meters" describes his antenna invention of U.S. Pat. No. 3,432,858 which he references on page 25 of that article. Of large importance, are his statements on page 25 which are marked "A" and "B" on the copy submitted with my application. Statement "A" shows that Mr. Brown's means for tuning "consists of telescoping brass tubings . . . " and his statement "B" reads: "The antenna system comprises an end-loaded dipole with matching impedance in the center." It is clear: Mr. Brown's invention frequency tuning is done primarily with the linear straight section of his antenna as he states—and again—he confirms that his antenna invention requires an impedance matching device—in the center—exactly as was shown in his patent drawing.

In said article, Mr. Brown calls his spiral antenna sections 'coils.' He refers to his spiral coils as "end-loading" devices. Such commonly used antenna end-loading devices are passive in nature and due to their passivity they are not designed, nor intended to be significant contributors of RF antenna radiation.

On page 28, the sentence marked "C" in the submitted 73 *Magazine* copy points out that Mr. Brown's antenna invention requires "a trap in each coil to permit operation on the two bands."

An antenna "trap" is another commonly used antenna add-on device which is employed to obtain operation on a frequency other than the primary frequency for which the antenna is designed. Such "trap" is any suitable combination of capacitor, inductor or both. The purpose of the "trap" is to alter the antenna element circuit parameters of resistance and reactance so that a resonant condition appears. Thus, it is abundantly clear to the reader that Mr. Brown's antenna design—which he cites in said 73 *Magazine* article as "U.S. Pat. No. 4,432,858"—requires an extraneous antenna trap electrical components—added to his end spirals—in order for his antenna to work on a frequency other than the primary resonating frequency! No such devices whatsoever are found in my antenna invention.

In the March 1998 issue of *WorldRadio*, Mr. Petlowany published an article entitled "From out of the Past—antennas with a new twist." It is a spiral dipole antenna. As he states in this article (marked "A" on the submitted copy), Mr. Petlowany's experiments led him to formulate what he calls "The Petlowany Principle" which states that "if a length of wire is wound into a spiral-shaped coil and excited by a radio frequency current connected to the innermost portion of the coil, it will then, and only then, exhibit RF characteristics that closely approximate those of a resonant linear wire of the same length." It is clear that he does not purport his antenna to be resonant . . . only "closely approximate" and, as we read, he excludes any portion of the coil other than "the innermost portion." Unknown to him, useful benefits are achieved when the radio frequency current connection is located on the spiral coil other than the innermost portion of the coil. His principle is made invalid with my antenna invention as the radio frequency current can be connected to any portion of the spiral coil and generates RF resonance exactly equivalent to those of a resonant linear wire.

Also, Mr. Petlowany's antenna has balanced RF antenna current. Again, Mr. Petlowany's antenna and my antenna invention are two completely different phenomena in operation.

There is a matter of vital importance to the reader in association with the experiments done by Mr. Petlowany: he employed a feed point current balun. Although he does not specifically mention this fact in the text of his article, he presents a photograph showing this device which is clearly labeled "Feedpoint current balun" (marked as "B" on the submitted copy.) As we know, a balun is used for impedance matching the antenna feed point with the characteristic impedance of the transmission line. Very simply stated, a balun is not required whatsoever with my antenna invention to achieve impedance matching.

Mr. Petlowany states in his article (marked as "C" on the submitted copy) that "If the linear portions are long enough in terms of the wavelength of the applied RF current, an appreciable amount of radiation takes place resulting in an efficient antenna." The reader will notice that Mr. Petlowany's 'linear portions' in his antenna are the same function as the 'co-linear segments' of Mr. Brown's antenna and both gentlemen rely upon for this "linear" part of their respective antennas for primary antenna radiation. The spiral elements ARE the primary antenna radiators in my antenna invention and any "linear" portions have negligible radiation: completely reverse operation.

Mr. Petlowany states (marked as "D" in the submitted copy) that "Multibanding antennas are possible by using multiple coils to resonate the short linear portion of the antenna at the desired frequencies provided that sufficient spacing between coils is allowed to prevent detuning of the individual coils." He does not state that "multibanding" is indeed inherently manifest without using multiple coils. Just as importantly, Mr. Petlowany relies upon the spiral coils to resonate the short linear portion in his antenna just as Mr. Brown relies upon the spiral tuning coils to resonate the short linear portion in that antenna.

In my antenna invention the spiral coils are the resonant portions of my antenna and the radiating portion of my antenna. My antenna provides true multiband performance without additional coils.

For the record, there was another article that was published in *RadioWorld* entitled "Variations on a Petlowany" by William Caldwell Sr. He describes his simple experiments with "Petlowany" antennas. His limited experience was strictly with a spiral antenna using one spiral element; he makes no mention of any linear portions or reference to radiating segments.

These magazine articles are written by Individual Amateur Radio enthusiasts. The experiments they performed are typical of what is referred to in that hobby as 'homebrew' construction. Such rough construction is of 'one of a kind', made with materials 'on hand', and by nature of such construction, not intended for long time use or commercialization.

The last category of prior art are cited patents that have some possible relationship to the present invention in this application. They are relevant as these cited patents utilized spiral antenna geometry. Inspection of these cited patents show significant departure from the invention of this application for the following reasons;

1.) Certain antennas have multiple spiral arms and/or exact Archimedes spiral formula;
2.) Certain antennas include inherent balun or other matching components;
3.) Certain antennas have spiral geometry that mechanically rotate to achieve tuning;
4.) Certain antennas use fractal geometry.

The antenna invention presented in this application does not employ a motor for tuning; does not use exact Archimedes spiral geometry; does not employ a balun or other matching device; does not have spirals that rotate by mechanical means; does not use fractal geometry.

OBJECTS AND ADVANTAGES

The objects and advantages of my invention provide an antenna having improvements compared to the above mentioned relevant prior art arrangements. Accordingly, the following information states such useful benefits.

This antenna is very efficient and performs well very close to ground terrain. Elevation above ground as low as 0.037 wavelength has provided long range communication in both vertical and horizontal orientation. It needs no optimum height.

This antenna support structure is made from polymer materials formulated for long term, inclement and extreme temperature weather exposure.

This antenna exploits the merits of unbalanced RF antenna current in spiral radiating elements and it provides the following useful benefits:

1. plurality of resonant frequencies for transmit and receive operation;
2. uniquely wide frequency bandwidth with low Standing Wave Ratio in that extensive range;
3. beam-effect and directivity of radiation pattern;
4. very high efficiency of operation over this very extensive frequency range;
5. multiple resonances with impedance matching without need of add-on devices;
6. wide choice of transmission line characteristic impedance to feed this antenna;

Further objects and advantages of my invention will become apparent from a consideration of the drawings and ensuing description.

SUMMARY

In accordance with the present invention a compact, physically small spiral antenna has improvements over prior art with said improvements providing transmission and reception of radio waves with more useful frequency relationships, frequency bandwidth and Standing Wave Ratio not previously obtainable with a simple dipole antenna. Whereby said antenna accomplishes such transmission and reception without the need to employ extraneous devices or components to achieve resonance with impedance matching for efficient RF power transfer from the transmission line. This antenna invention is made from materials and uses construction techniques which assure said transmission and reception in extreme weather conditions.

DRAWINGS—FIGURES

In the drawings, closely related figures have the same number but different alphabetic suffixes; three digit reference numerals are used wherein the first digit represents the introductory drawing of that item.

FIG. 1C shows the spiral support tube.

FIG. 1D shows a cross section through a notch.

FIG. 1O shows a top view of antenna and signal strength change with antenna orientation.

DRAWINGS—REFERENCE NUMERALS

| | |
|---|---|
| 101 | boom |
| 102 | holes for end support tubes |
| 103 | holes for nylon locking ties |
| 104 | holes for mast mount |
| 105 | holes for bolt electrical terminals |
| 106 | spiral support tube |
| 107 | notches to grip spiral wire |
| 108 | holes for nylon locking tie |
| 109 | generic nylon locking tie |
| 110 | bolt terminals |
| 111 | transmission line |
| 112 | mast mount |
| 113 | "hot" spiral radiating element |
| 114 | "hot" connecting wire |
| 115 | "cold" spiral radiating element |
| 116 | "cold" connecting wire |
| 117 | mast |
| 119 | mounting plate |
| 301 | "hot" spiral wire radiating element |
| 302 | "cold" spiral wire radiating element |
| 301a | spiral segment |
| 301b | spiral segment |
| 302a | spiral segment |
| 302b | spiral segment |
| 311 | "FIG. 8" "hot" spiral radiating element |
| 312 | "FIG. 8" "cold" spiral radiating element |
| 311a | spiral segment |
| 311b | spiral segment |
| 311c | spiral segment |
| 312a | spiral segment |
| 312b | spiral segment |
| 312c | spiral segment |
| 613 | parasitic spiral for "hot" spiral radiating element |
| 615 | parasitic spiral for "cold" spiral radiating element |
| 713 | parasitic spiral for "hot" spiral radiating element |
| 715 | parasitic spiral for "cold" spiral radiating element |

DETAILED DESCRIPTION—PREFERRED EMBODIMENT—FIGS 1A THROUGH 1O

Figure 1A:
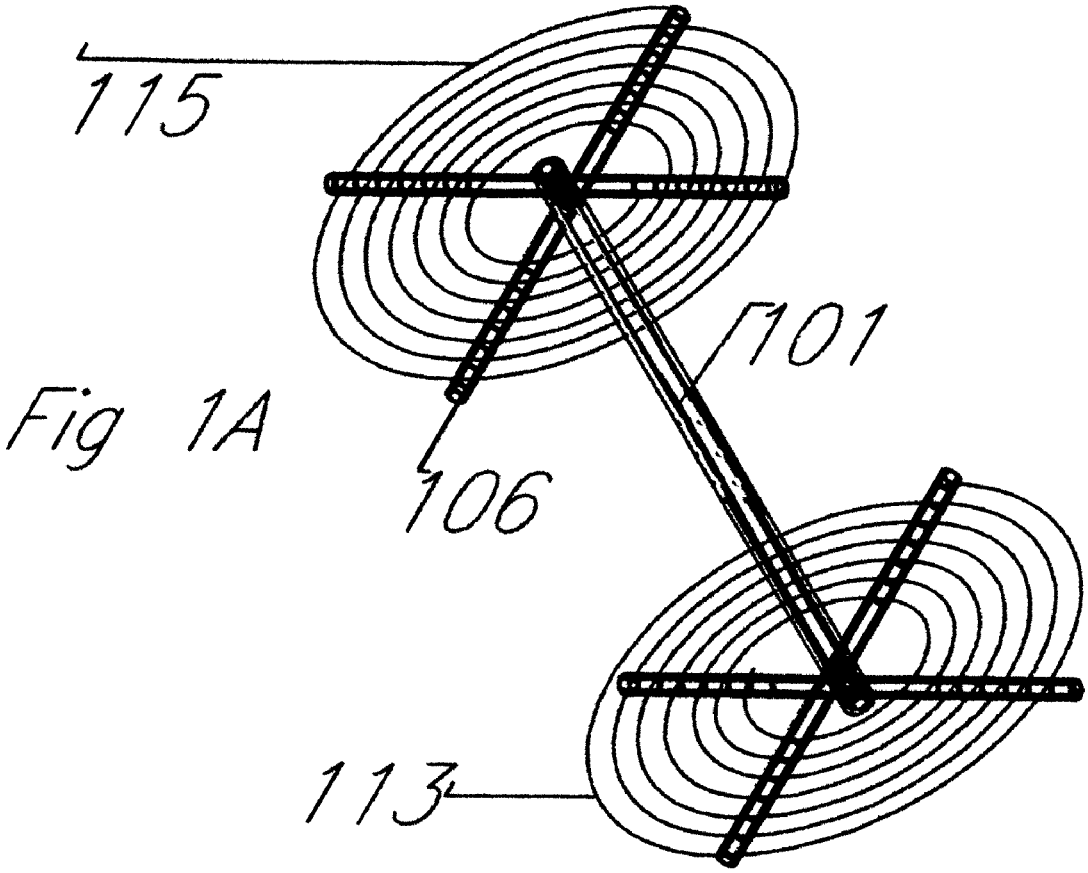
FIG. 1A shows the isometric view of antenna with a spiral dipole construction.

A preferred embodiment of the antenna of the present antenna invention is illustrated in FIG. 1A (isometric view.) Antenna has a boom 101 made from commercial grade 1 inch diameter schedule 40 electrical conduit pipe; other dimensions can be used depending upon the need for structural integrity. Boom is 30 inches in length however its length can be as short as 2 inches and as long as 20 feet. The material composition of this conduit is specially formulated to withstand extreme hot and cold temperatures and long term exposure to outdoor weather conditions; it is made to be sunlight resistant to prevent degradation from ultraviolet exposure; it is suitable for burial underground and can withstand immersion in water having chemistry of wide pH range.

Four spiral support tubes 106 are ½ inch diameter schedule 40 conduit made from the same material as the boom 101. Other dimensions can be used depending upon the need for structural integrity. Each support tube is 30 inches in length however this length will vary depending upon the frequency at which the antenna is to be operated as the support tubes need to be long enough to accept the length of wire determined by the resonant frequency. Two spiral support tubes are used at both ends of the boom.

Two spiral radiating elements 113 and 115 are composed of copper jacketed alloy wire. Gage of said wire is determined by current carrying capability as specified by National Electrical Manufacturers Association standards. The length of wire for the spirals is determined by the equation for resonant frequency provided in the section on antenna operation which follows. Spiral 113 is referred to as the 'hot' spiral as it is connected to the RF coax transmission line center conductor. Spiral 115 is referred to as the 'cold' spiral as it is connected to the RF coax transmission line outer shield. The terms "hot" and "cold" will be used for reference when other kinds of transmission cable are discussed.

Each spiral is electrically connected to the transmission line with connecting wire 114 for the 'hot' spiral and connecting wire 116 for the 'cold' spiral. These wires are primarily for electrical construction convenience; the transmission line may also be directly connected to the associated wire spiral radiating elements. Gage of said wire is determined by current carrying capability as specified by National Electrical Manufacturers Association standards. The RF coax transmission line 111—has a length that will depend on the distance to the radio receiver and/or transmitter.

Transmission line referred to as 'balanced' or 'twin lead' or 'ladder line' is also acceptable for use as well as any two conductor cable.

Figure 1B:
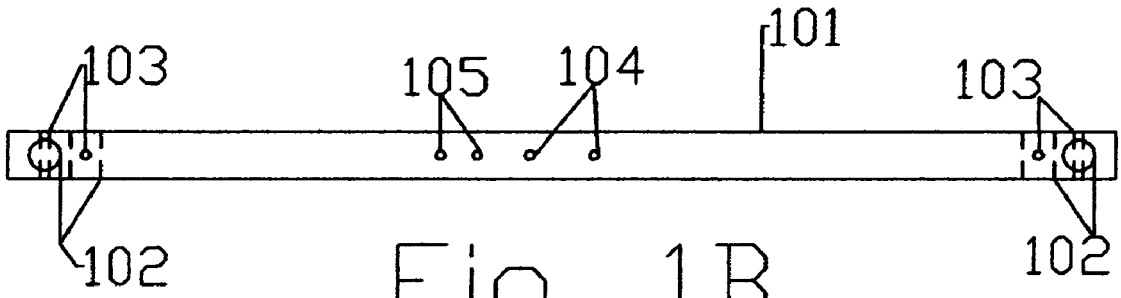
FIG. 1B shows the antenna boom.

FIG. 1B shows details of the boom 101 in front view. Four large diameter through holes 102 are for insertion of the four spiral support tubes 106. There are four small diameter through holes 103 centered on each large diameter hole but the smaller holes are shifted 90 degrees with respect to the complimentary large hole to allow for passage of nylon locking tie 109 to secure support tubes with the boom. There are two small diameter through holes 104 for insertion of the U-bolt which holds the boom to the mast. Two small diameter holes 105 are for insertion of bolts which act as electrical terminals to join the transmission line with each connecting wires 114, 116.

FIG. 1C shows the construction of said spiral support tube 106. A series of notches 107 are cut into the spiral support tube which serve to secure the wire segment of each spiral wire radiator 113 and 115 with a compressive force as the wire is squeezed into each notch. Placement of the notches enables spiral geometry to be formed for each spiral wire radiator 113,115 when the wire is wound in a circular motion while being inserted into each and every notch. With regard to this embodiment, the notches are symmetrically placed on either side on the spiral support tube center; the inner most notch being 5.5 inches from center; notch spacing is 1.5 inches; 14 notches in total. FIG. 1D is a cross section through the support tube 106 at a typical notch location. There is a small diameter through hole 108 which is used to secure each support tube to the boom 101 using a nylon locking tie 109.

Figure 1E:
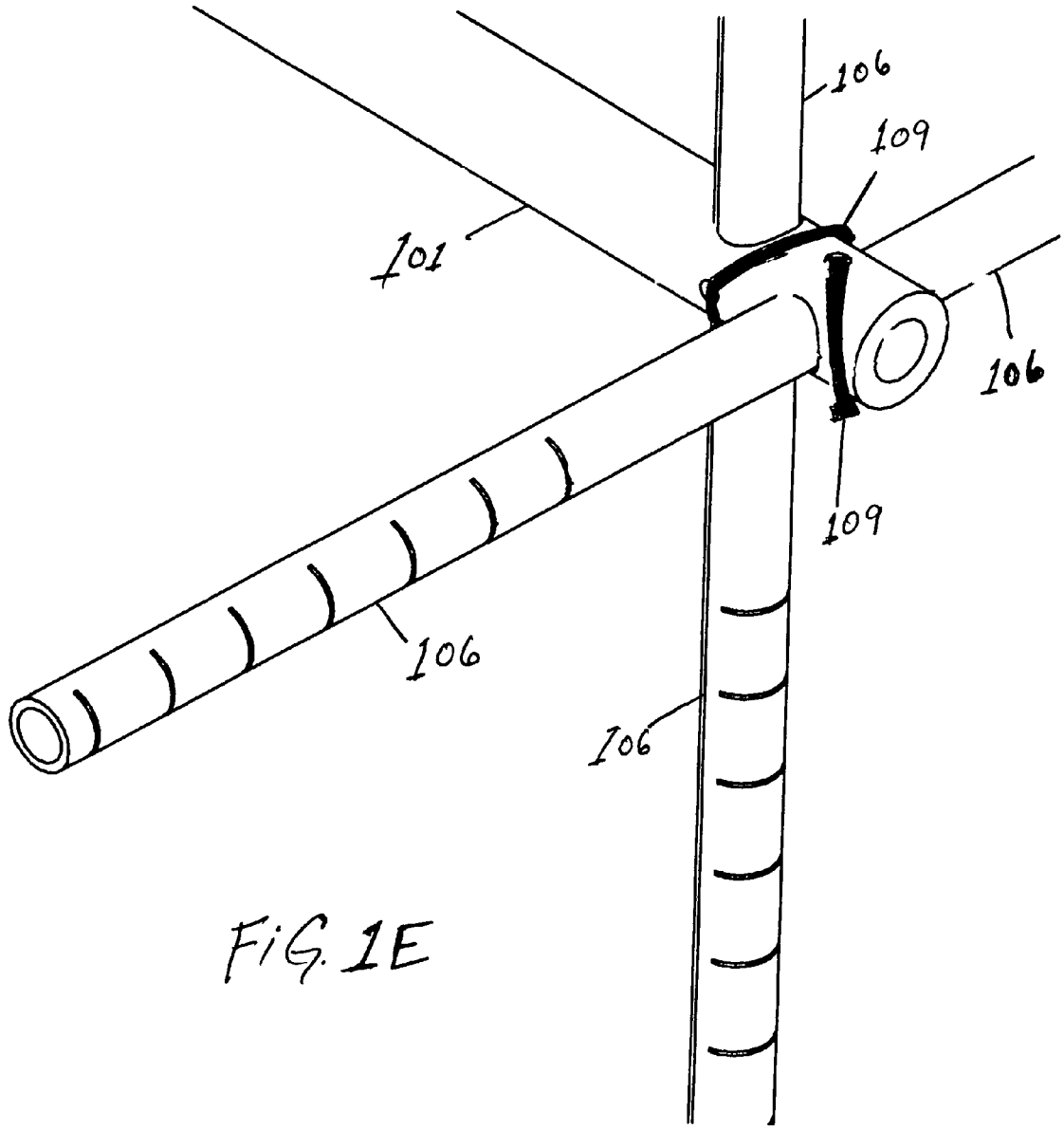
FIG. 1E shows the one end of the antenna boom having two spiral support tubes installed and shows the black nylon locking tie being used to secure each spiral support tube at the boom end.

FIG. 1E shows a two spiral support tubes 106 inserted into the boom 101 end using two nylon locking ties 109 for secure placement. The spiral support tubes are shown with the notches facing the boom end; the support tube nearest to the boom end may also be arranged such that the notches of both spiral support tubes face each other.

Figures 1F, 1G, 1H:
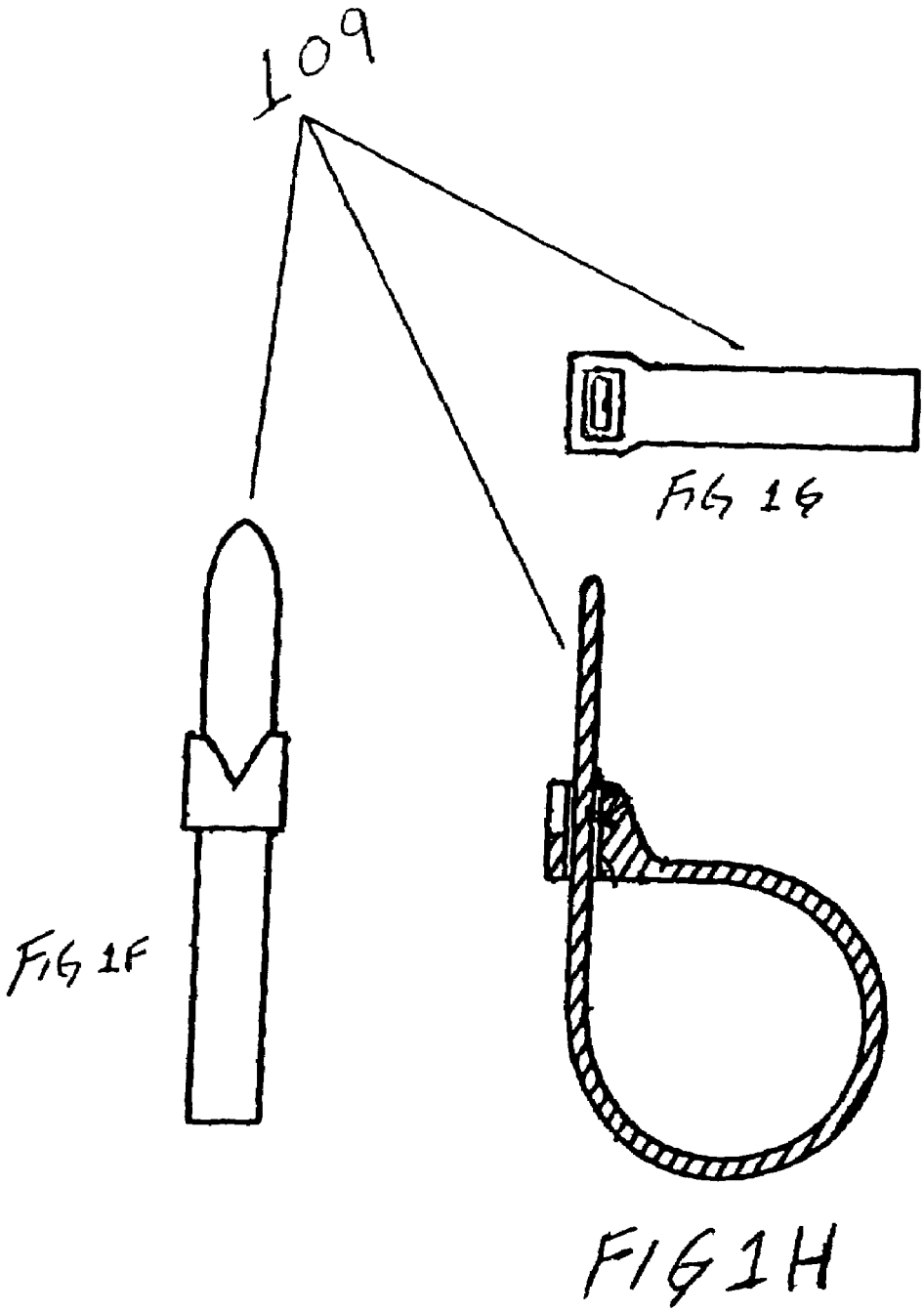
FIG. 1F shows a generic nylon locking tie—side view.
FIG. 1G shows a generic nylon locking tie—top view.
FIG. 1H shows a generic nylon locking tie—front view.

FIGS. 1F, G and H show the construction of a generic locking tie 109 in side, top and front view respectively in the closed and locked position when it is in use to secure components in place.

Figure 1I:
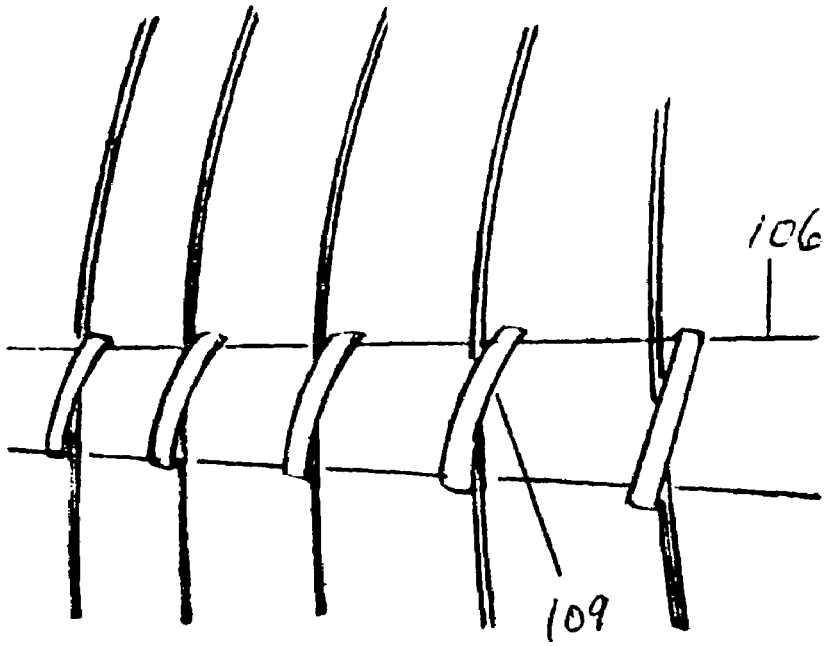
FIG. 1I shows the spiral wire residing in notches of end tube support and retained in place with nylon locking ties.

FIG. 1I shows how each wire segment of the each spiral wire radiator 113, 115 that is embedded into a notch 107 is also permanently secured by placement of a nylon locking tie 109 at each notch location on the spiral support tubes 106.

Figure 1J:
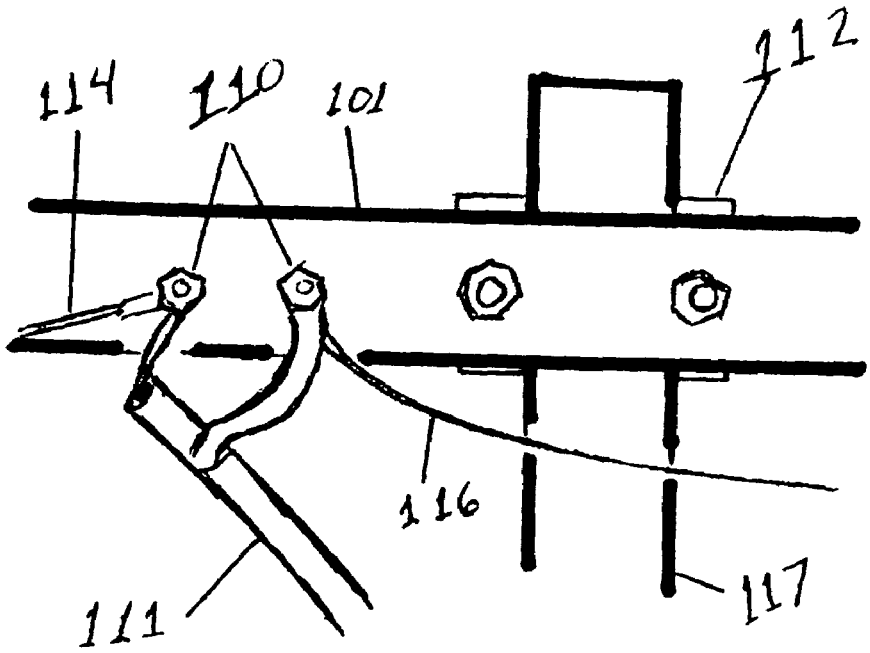
FIG. 1J shows a typical transmission line attachment using the bolt terminals and boom attachment to mast.

FIG. 1J shows the coax transmission line 111 and connecting wires 114, 116 joined and secured to the boom 101 using nut and bolt hardware 110. Shown In FIG. 1J also is the boom 101 being secured to the mast 117 with a customary U-bolt and saddle attachment 112.

Figure 1K:
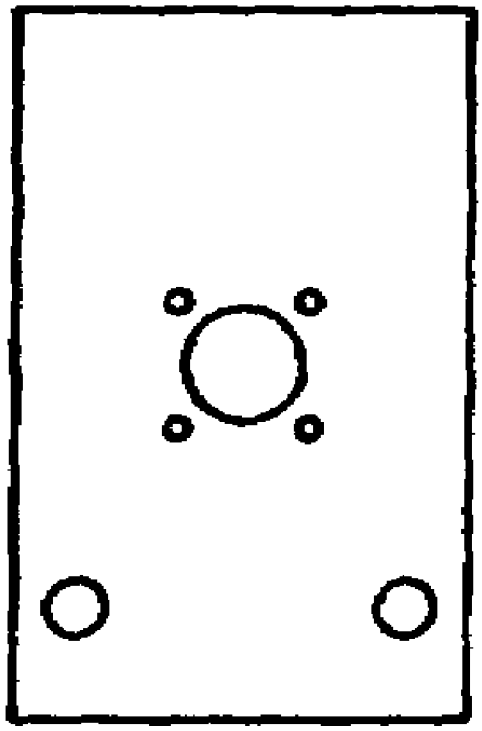
FIG. 1K shows generic mounting plate for optional RF connector.

FIG. 1K shows a mounting plate 119 for a commercial RF connector as an option to using terminal bolt hardware 110. One such arrangement would be affixing the mounting plate using the U-bolt legs.

Figure 1L:
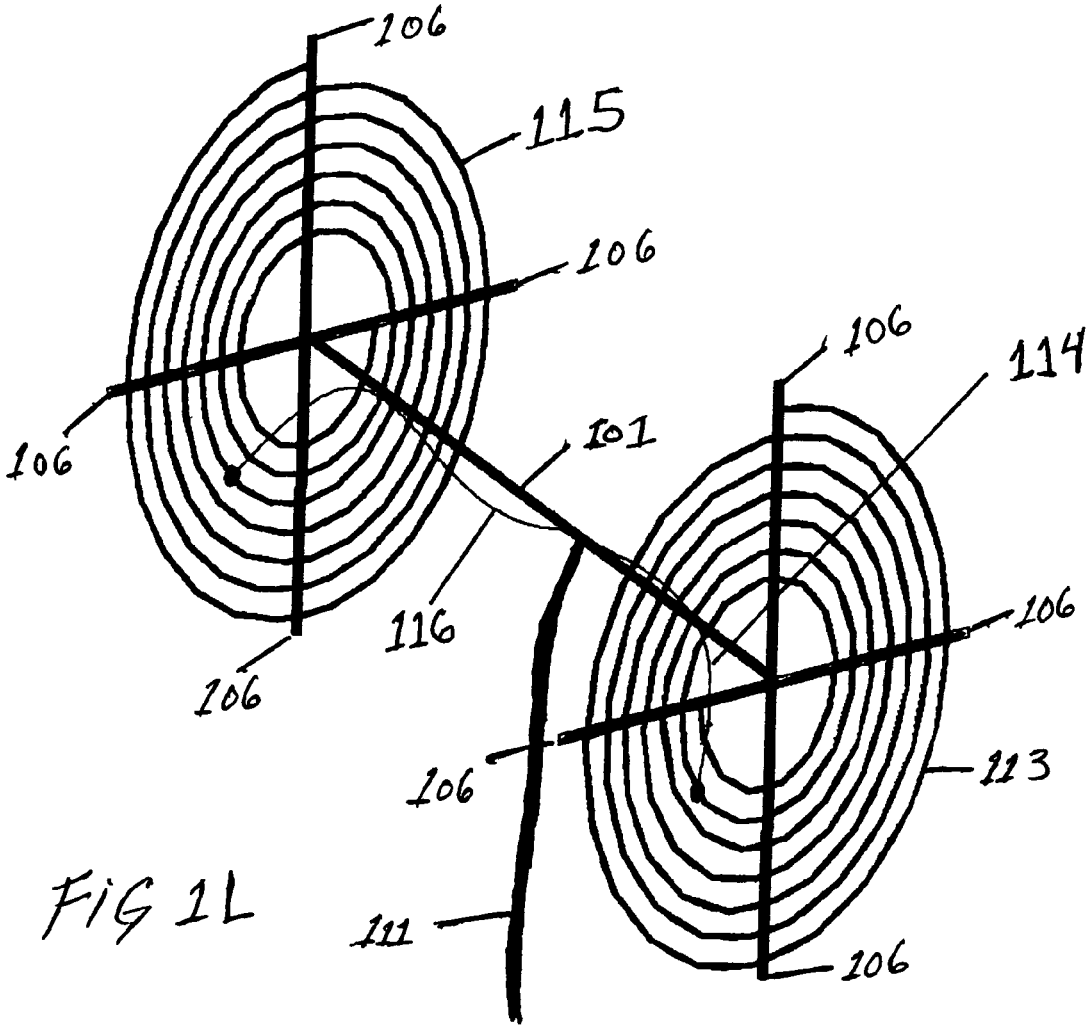
FIG. 1L shows a schematic diagram of typical wiring of the transmission line and connector wires going to each spiral radiating element.

FIG. 1L is a schematic diagram showing the dipole antenna spiral radiating elements wound in opposite directions with reference to the boom 101 center and having the connecting wires 114, 116 placed onto each spiral radiating element whereby unbalanced RF antenna current and achieve resonance is achieved. The reader will please notice that the connecting wires need not be symmetrically placed with regard to the spiral centers. Any portion of each spiral radiating element may be utilized for connection.

Said antenna is intended for operation outside of a structure or building. Therefore, the materials and construction used for said antenna must be of such composition and design to withstand outdoor weather conditions. Such conditions include rain, snow, ice and hail, large temperature cycling from extreme cold to extreme hot, high wind velocity and sunlight exposure. One improvement over prior art is the material composition and construction of said antenna. The material used for said antenna boom 101 and spiral support tubes 106 is commercial grade electrical conduit piping. Commercial grade electrical conduit piping composition is approved by and has quality control set by standards of Underwriters Laboratory and extensively used on a national basis for exactly the kind of outdoor weather conditions to which said antenna will be exposed.

The nylon locking tie 109 has material composition making it resistant to chemical attack from solvents, alkalis and acid rain; it is black in color and resistant to ultraviolet exposure; it has high tensile strength and meets specification of military standard MS-3367-5-0. Said antenna construction design uses the nylon locking tie 109 in place of metal hardware to maintain structural integrity of the boom 101 connection with the spiral support tubes 106. Thus, mechanical failure due to metal corrosion is eliminated.

Said antenna uses the superior material quality of the electrical conduit piping composition to secure and maintain the geometric integrity of the spiral radiating elements 113, 115. The wire segments of said spiral wire radiators are firmly affixed by insertion of the wire segments into notches 107 located along the length of each spiral support tube 106. While it resides in said notch, each wire segment is subject to compressive force which retains said wire segment in the notch. Additional placement permanence is achieved by covering each wire segment and notch location with the high tensile strength nylon locking tie 109.

Each spiral radiating element 113,115 is made from high tensile strength copper coated alloy. The spiral geometry of spiral radiating elements can be made with straight line segments rather than having a continuous curvature shape. The spiral radiating elements shown in FIG. 1A are wound in the opposite direction with reference to the boom 101 center as reference. They may also be wound in the same direction with reference to the boom 101 center as reference. Also, each or both spiral planes can make any angle with the boom axis as reference.

The wire used to form the spiral radiating elements has a "cast." Wire cast is due to the residual inherent arrangement of metal grains set in place during the manufacture of the wire alloy. Any attempt to change the wire cast dimension will require force. Any force is met with an equal and opposite force. Thus, when force is used to affix the wire into the notches 107 of the end support tubes 106 to create the spiral geometry, the wire cast dimension is changed from large diameter to smaller diameter due to the changing radius of the spiral geometry. The residual strain in wire exerts a force that is applied to every contact point that the wire makes within each notch. This force also helps retain the wire in place within each notch and prevents the wire segment from popping out.

The sum of each of these individual notch forces generates a resulting force whose center is located at the intersection of the boom 101 and each support tube center. This force radiates outward along the length of the spiral support tubes 106. This force reduces stress at the boom 101 and support tube 106 location and also provides additional structural integrity to this assembly.

Such material composition and construction proves said antenna with excellent long term outdoor climate exposure longevity and ability to withstand extremely hostile weather forces. Said antenna is most durable to rough and harsh handling as may be found in emergency communications services during a hurricane event.

OPERATION—PREFERRED EMBODIMENT—FIG. 1A TO FIG. 1O

The following information pertains to the operational improvements provided by the antenna in this patent application shown in FIG. 1A, FIG. 1L and other embodiments over prior art and cited references with regard to radio frequency electromagnetic characteristics—the essential factors for understanding how different this antenna invention is.

As mentioned earlier, prior art and cited references pertain to antennas that are made resonant with balanced RF antenna current. Indeed, to cite Mr. Brown's own words, his antenna invention is "completely balanced".

Textbooks, engineering handbooks and other important antenna literature abound with theory, performance and designs that are primarily devoted to resonant antennas that have balanced RF antenna current. Conspicuously absent is literature on the attributes of a dipole antenna having unbalanced RF antenna current!

Balanced RF antennas are easier to model analytically and experiments using them are also easier to comprehend. Resonant and balanced dipole antennas are easier to construct and their operation is easier to understand. Resonant dipole antennas that are balanced pose small technical challenges to established expertise and skill level when one wishes to achieve high level performance. Resonant and balanced dipole antennas make life easy; the useful benefits of an antenna that are not resonant and have unbalanced RF antenna current have been largely ignored.

A balanced dipole antenna has an equal amount of RF current flowing in the circuit of the radiating wire elements. Resonance at a chosen frequency is determined by the chosen values of circuit electrical parameters—namely conductor length, conductor inductance, conductor capacitance and conductor resistance.

A resonant and balanced dipole wire antenna is obtained by having equal wire length, equal wire inductance, equal wire capacitance and equal wire resistance in the wire radiating elements. The dipole antenna in this patent application is made resonant and has RF current that is unbalanced. As improvement over Mr. Browns' invention, the wire spirals in my antenna invention are the primary radiating elements and not solely used for resonance tuning. Moreover, the wire spiral radiating elements are designed to provide resonance and impedance matching to the transmission line at the same time. This is the quintessential difference between my antenna invention and prior art.

The dipole antenna in FIG. 1A, FIG. 1L is made unbalanced by having RF current travel through one wire spiral radiating element that is physically longer in length than that RF current traveling through the other wire spiral radiating element 113, 115. Thus, the circuit electrical parameters—inductance, capacitance and resistance are different in each of the two wire spiral radiating elements. The reader will notice that this condition is completely different from the balanced dipole antennas referenced in previous art.

Those readers familiar with the art know that the resonant frequency of a dipole antenna—that is balanced—is determined by its length of wire; the formula for determining its resonant frequency, Fres is: Fres=486/L—where Fres is given in megahertz and L is the length of wire used for that balanced dipole antenna. The equation for resonant frequency pertinent to the antenna invention embodiment shown in FIG. 1A, FIG. 1L is Fres=558/L—where Fres is given in megahertz and L is the total length of wire used for the spiral wire radiating elements at the lowest frequency for which resonance it desired. Rearranging terms, the one-half wavelength length of wire for a standard balanced dipole is L=486/Fres; the one-half wavelength length of wire for the dipole antenna is FIG. 1A, FIG. 1L is L=558/Fres.

Said equation is cited for this embodiment and shows the numerical difference with the standard equation. The value of the numerator can and will vary depending upon the electrical circuit parameters chosen for the spiral radiating elements. It should be noted that the numerator in all the resonance equations in this patent application is cited for the embodiment associated with said equation and said equations will have varying numerator values that are determined by antenna design factors that vary from said associated embodiment.

The antenna in this patent application uses wire length this is uniquely much longer than that wire length given by the standard equation for one-half wavelength and accordingly, one-quarter wavelength resonant frequency. Wire lengths for the antenna radiating elements are uniquely longer than wire used in prior art and cited references. Accordingly, the spiral radiating elements 113,115 are significantly longer than one-quarter wavelength spiral elements used in prior art and cited references. Additionally, each spiral radiating element 113, 114 has a different length of wire in its construction which generates the unbalanced RF current condition in said antenna. The length difference may be as large as 35% in ratio. Said lengths can be equal when the placement of the electrical connecting wire to each spiral generates an RF current unbalance condition.

FIG. 1L shows a schematic wiring diagram of the electrical attachment of "hot" connecting wire 114 to the "hot" spiral radiating element 113 and the attachment of the "cold" connecting wire 116 to the "cold" spiral radiating element 115 with reference to FIG. 1A. Spiral wire radiating element 113 is called "hot" as it is connected to the "hot" or center conductor of the coax transmission line. Spiral wire radiating element 115 is called "cold" as it is connected to the "cold" or shield of the coax transmission line.

The antenna in FIG. 1L has unbalanced RF antenna current due to different wire length in each spiral radiating element and said antenna has much longer wire than the standard resonant dipole antenna. It follows that the spiral radiating elements have different electrical length. In this unbalanced electrical state, the use of the connecting wires 114,116 is primarily for electrical attachment to the spiral elements. Said connector wires are not intended for primary contribution to RF radiation. This operation is opposite that of prior art.

Specific reference is made to Mr. Brown's invention FIG. 1, 60 wherein he restricts his electrical attachments to his spiral elements to not more than 120 degrees of excursion. To be clear on this matter, the reader will notice in FIG. 1L the electrical attachment of the "cold" connecting wire 116 is extending out to 855 angular degrees from the inner spiral end on the "cold" spiral radiating element 115 and the electrical attachment of the "hot" connecting wire 114 is extending out 405 angular degrees from the inner spiral end on the "hot" spiral radiating element 113.

Each spiral radiating element has its own unique electrical circuit parameter—namely inductance, capacitance and wire resistance. Any combination of said electrical parameters may be designed and determined by the frequency of antenna operation. Resonant frequency is selected by the user via the placement of the connecting wires 114, 116 onto the wire spiral radiating elements 113, 115. Said spiral radiating element geometry can have unequal spacing between adjacent conductors and approximate spiral-like geometry to obtain various electrical circuit parameters.

It is of utmost importance for the reader to notice that resonance of said antenna in FIG. 1A, FIG. 1L does not require nor incorporate any extraneous loading devices or "trap" components to appear as a resistive load for the transmission line. Impedance matching to the transmission line is accomplished by the placement of the connecting wires 114, 116 onto the spiral wire radiating elements 113, 115 whose electrical parameters provide said matching and also provide the resonant frequency.

The resonant frequency of said antenna design in this patent application can range from very low RF frequency to the ultra-high frequency in the radio spectrum. Therefore the information provided for the antenna of this patent application can be used for the design end construction for dipole antenna use over a wide range of radio spectrum.

Measurements were made on the operation of the resonant and unbalanced antenna in this patent application. Actual field data was obtained on said antenna using a laboratory grade Network Analyzer—Hewlett Packard model 8752A.

Figure 1M:
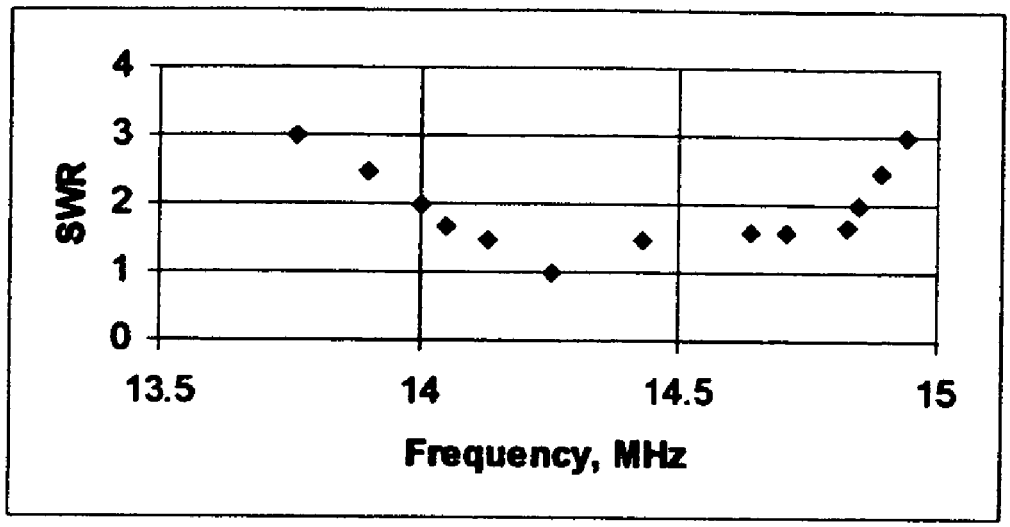
FIG. 1M shows wide Standing Wave Ratio bandwidth at 20 meters.

The first useful benefit is extended operating frequency bandwidth. FIG. 1M is a graph showing Standing Wave Ratio (SWR) in the frequency range from 13.5 MHz to 15 MHz for embodiment of the antenna shown in FIG. 1A, FIG. 1L. The resonant frequency of 14.250 MHz was chosen and an antenna was fabricated as per previous information. FIG. 1M shows this resonant frequency having an SWR of 1.0 which is to be understood as the SWR ratio of 1:1. Most notable is the range of low SWR over the large frequency span. The range for a 2:1 SWR is 850 Kc; the range for a 3:1 SWR is 1.18 MHz. The reader will recall that the said antenna boom is only 30 inches long. A 30 inch dipole antenna operating in this frequency range is nominally $1/26^{th}$ or 0.04 physical wavelength in size. A dipole antenna of this small relative dimension is not known to provide such very wide operating characteristics and versatility . . . yet it is accomplished.

Figure 1N:
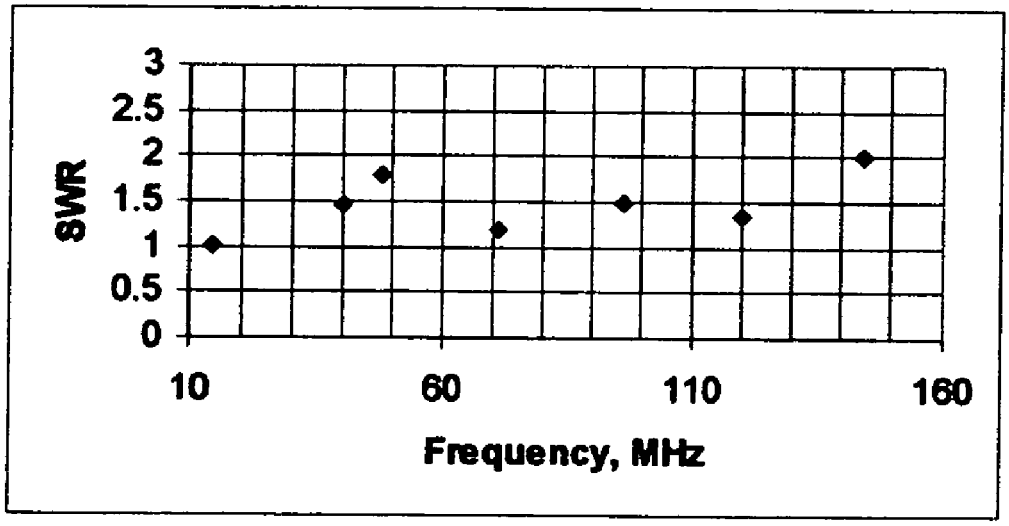
FIG. 1N shows low Standing Wave Ratio and resonant frequencies spanning a uniquely large spectrum.

The second useful benefit is operational performance at several widely spaced frequencies. The field date used for FIG. 1N shows SWR in the frequency range from 10 MHz to 150 MHz using said antenna shown is FIG. 1A, FIG. 1L. Frequencies having an SWR of 2:1 or less are: 14.25, 40, 47.8, 71.2, 96.4, 119.8, 144.4 MHz. The widely spaced operating frequencies can easily be selected by the user and then the appropriate spiral radiating element electrical parameters can be employed.

The third useful benefit is directivity and beam effect of the antenna radiation pattern. FIG. 1O is a diagram showing four antenna positions of horizontal boom 101 orientation for said antenna shown in FIG. 1A, FIG. 1L. For each orientation, the "hot" and "cold" spiral wire radiating element 113,115 is labeled. For each of the four positions an "S" number is shown as determined from field data; this "S" number is the signal strength number registered on a strength meter (referred to as an "S meter") of radio receiver located 500 miles away from this same antenna. This information clearly shows higher received signal when the "cold" spiral radiating wire element is pointing in the direction of the receiving radio. Indeed, the difference between an "S8" and an "S4" in on the order of 24 dB. Thus, the reader will readily see the large benefit from rotating said antenna.

The fourth useful benefit is the high level of receiving and transmitting performance of the antenna shown in FIG. 1A, FIG. 1L at very low elevation and very close to ground level. Said antenna does not need an optimum height for resuming maximum distance for reception or transmission. Indeed, it has demonstrated operating performance at 1/10 of Mr. Brown's optimum height. The antenna shown in FIG. 1A, FIG. 1L has been field tested as close as 0.037 of the operating wavelength from the ground and has made contact with radio stations as far away as 2700 miles. Also, said antenna was placed in a basement of a residential structure five (5) feet below ground level; radio contact was made with a station 480 miles away. Thus, no optimum height is required for long distance communication for said antenna.

The fifth useful benefit provided by the antenna shown in FIG. 1A, FIG. 1L is the large amount to RF power it can accept and efficiently radiate. The antenna structural components are chosen for high electrical dielectric strength as well as long term durability in outdoor environments. Said antenna was tested with 1000 watts of continuous wave RF carrier at 3.5 MHz for 30 seconds using 14 AWG copper jacketed alloy wire; there was no discernable heat detected and no damage visible upon inspection. Immediately afterward, 1400 watts Peak Envelope Power of RF carrier at 3.5 MHz for 30 seconds was applied—and again—no discernable heat detected or damage visible upon inspection. This high power handling capability is obtainable as there are no extraneous devices necessary for impedance matching or resonance generation which can be damaged from such high power levels. Also, as there are no such extraneous components devices, there is no power loss from such devices absorbing power. The transmission line 111 is directly connected to the connecting wires 114, 116 which are directly connected to the spiral radiating elements 113,115. The result is a very efficient radiating antenna.

ALTERNATIVE EMBODIMENTS—FIG. 2 TO FIG. 7

Figure 2:
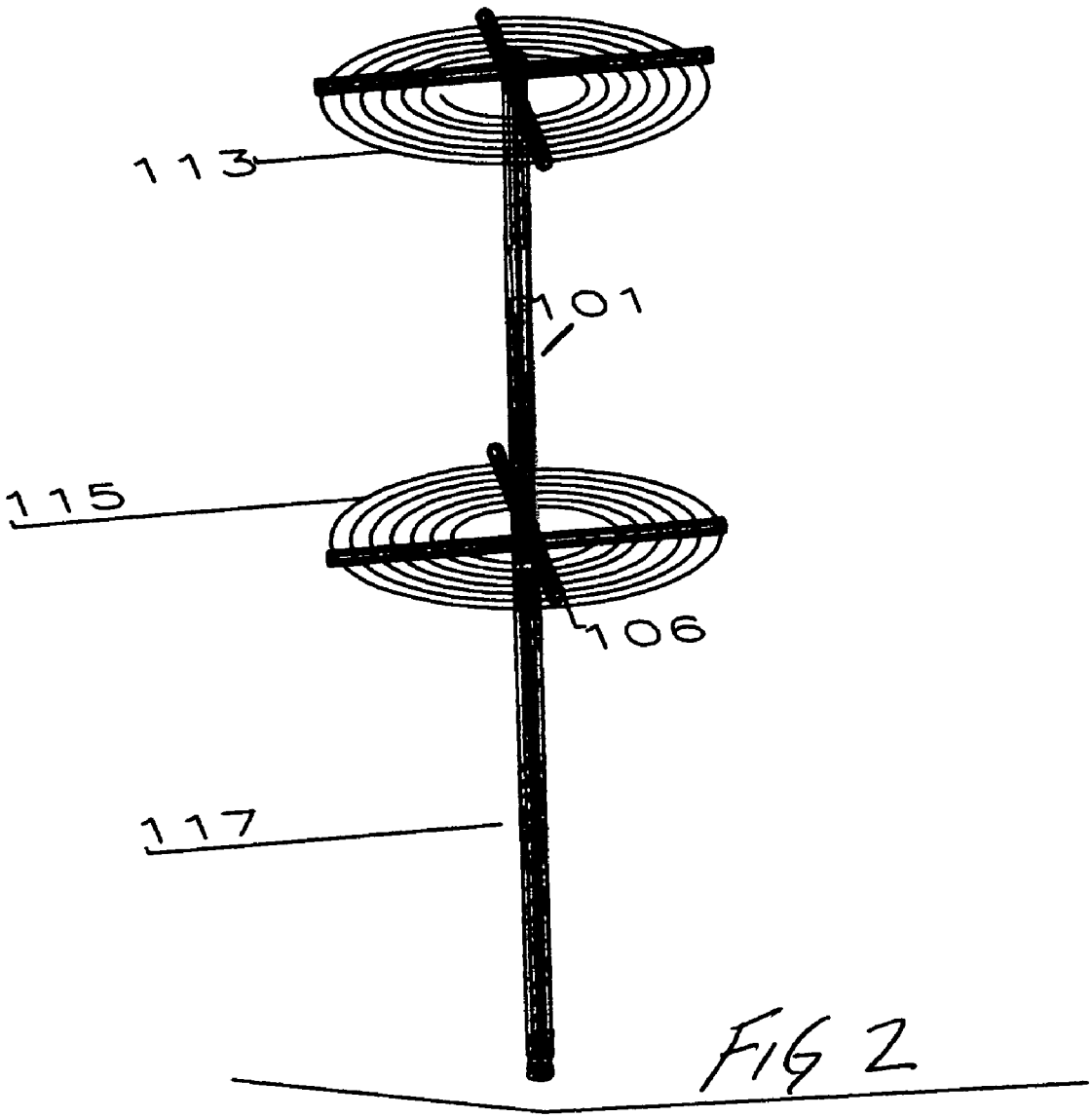
FIG. 2 shows antenna of FIG. 1A in vertical orientation

The embodiment shown in FIG. 2 depicts the antenna shown is FIG. 1A, FIG. 1L with vertical orientation as the antenna boom 101 is perpendicular to the ground plane. Said antenna has made contact with radio stations at distances of several hundred miles when it was erected at a height of only 0.037 wavelength above ground level. Also, said antenna is operable using just one spiral alone—namely spiral 113, for example.

Figure 3A:
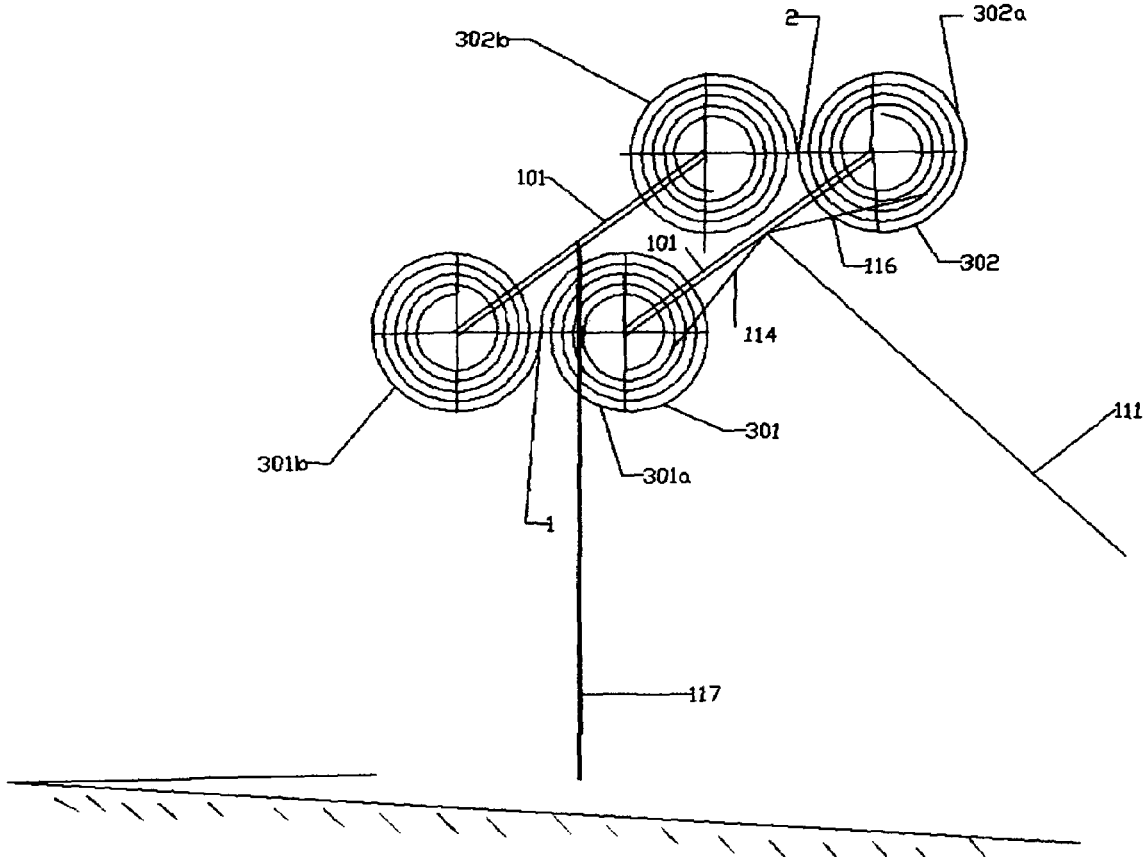
FIG. 3A is a schematic diagram of one embodiment of the dipole antenna of FIG. 1A with 'figure 8' spiral pattern.

I wish to call to the attention of the reader that the following embodiment and information may be of notable scientific achievement. FIG. 3A is a isometric view showing one embodiment of the spiral dipole antenna of FIG. 1A FIG. 1L wherein each spiral radiating element has a unique 'figure 8' spiral geometry with the plane of all said spirals being perpendicular with the ground plane. The antenna boom 101 is parallel with the ground plane. The reader will notice that the spiral dipole antenna in FIG. 3A still has only two spiral radiating elements as does FIG. 1A FIG. 1L and as such it remains to be a dipole antenna.

FIG. 3A simply shows a different way to configure each spiral radiating element of the dipole antenna using one continuous length of wire. Said antenna is still a dipole antenna. Said antenna has resonance and impedance matching to the transmission line at both the lowest primary resonant frequency and the first harmonic frequency without the need for any extraneous matching or tuning devices.

Radiating spiral 301 is the "hot" spiral radiating element and spiral 302 is the cold spiral radiating element. Each 'figure 8' radiating spiral, 301, 302 is one continuous length of wire. Each 'figure 8' radiating spiral is connected to the transmission line 111 by connecting wires 114,116. The transmission line can also be connected directly to said spiral radiating elements. The total length of antenna wire for both 'figure 8' spirals is determined by the chosen lowest primary resonant frequency equation: L8=624/F where L8 is in feet and F is the lowest resonant frequency in megacycles.

Each 'figure 8' radiating spiral element is composed of two spiral segments such that radiating spiral 301 is composed of spiral segments 301*a* and 301*b* and radiating spiral 302 is composed of spiral segments 302*a* and 302*b*. The wire length for spiral segments 301*a*, 301*b*, 302*a* and 302*b* are determined by the choice of operating frequencies whose length is in proportion to the frequency ratios as described subsequently.

Initially. each individual 'figure 8' spiral 301 and 302 is to have length L8/2. Depending upon the characteristic impedance of the transmission line 111, said initial lengths of the 'figure 8' radiating spirals 301,302 are then adjusted to have a different length of wire to range 0% to 35% in ratio of 301-302/301. The adjusted length of spiral 301 will be called "301 adj" and the adjusted length of spiral 302 will be called "302adj."

Then, spiral segment 301*b* will be given length (F/2F)× (301adj) where F is the lowest primary resonant frequency and 2F is the first harmonic frequency. Spiral segment 301*a* is given the length of 301adj minus the length of spiral segment 301*b*. Then, spiral segment 302*b* will be given length (F/2F)× (302adj) where F is the lowest primary resonant frequency and 2F is the first harmonic frequency. Spiral segment 302*a* will be given the length of 302adj minus the length of spiral segment 302*b*.

The location of the electrical attachment points of each connecting wire 114,116 onto each 'figure 8' radiating spiral is determined when the primary chosen resonant frequency is obtained at the appropriate low SWR reading which confirms resonance and impedance matching to the transmission line. These attachment points may be located at any point on each spiral radiating element. The geometry of the 'figure 8' spiral radiating element may be the same or different rotation with reference to points 1 and 2. FIG. 3A shows different rotation for each 'figure 8' spiral radiating element as they are not mirror images of each other. Also, the spiral geometry need not have continuous curvature and can be made using straight line segments.

The reader will notice that—here again—there are no extraneous devices or "trap" components whatsoever for impedance matching to the transmission line or for frequency tuning. There is a direct and uninterrupted electrical path from the transmission line 111 to the wire spiral radiating elements 301, 302. Said 'figure 8' spiral dipole antenna has operating performance not previously achieved with any dipole antenna.

For the first time in dipole antenna art, the spiral dipole antenna shown in FIG. 3A provides impedance matched resonance at a primary frequency, F and at its first harmonic frequency, 2F. Both resonant frequencies F and 2F will have antenna feed point impedance matched to the characteristic impedance of the transmission line. The reader will notice that no extraneous matching devices are employed with said spiral dipole antenna.

A resonant and balanced dipole antenna is not capable of having this harmonic frequency resonance and impedance matching to the transmission line because a resonant and balanced dipole antenna is operating as a full-wavelength dipole antenna at the second harmonic frequency, 2F. Operating at 2F, a full-wavelength balanced dipole antenna has RF current at a voltage (E) maximum and current (I) minimum at the transmission line feed point to the antenna. This ratio of high voltage to low current, E/I is termed a 'high impedance'. Typical high impedance vales can range from 5,000 ohm to 8,000 ohms for a full-wavelength dipole antenna. These high impedance values at frequency 2F greatly exceed that characteristic impedance value of the commercially available transmission lines. Indeed it is impractical to manufacture transmission lines having these high values of characteristic impedance!

The large impedance difference between the antenna feed point and the transmission line creates "impedance mismatch" and generates extremely high Standing Wave Ratio (SWR). This impedance mismatch therefore requires an extraneous device to match the antenna feed point impedance with the characteristic impedance of the transmission line at frequency 2F. The antenna invention shown in FIG. 3A does not have this problem because 'high impedance' does not exist at 2F in this Invention.

Figure 3B:
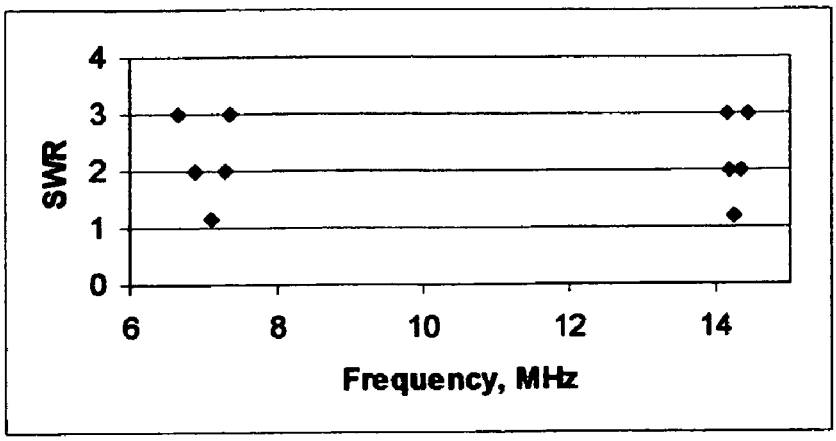
FIG. 3B shows a drawing of Dual Resonance Frequency vs. Standing Wave Ratio
Figure 3C:
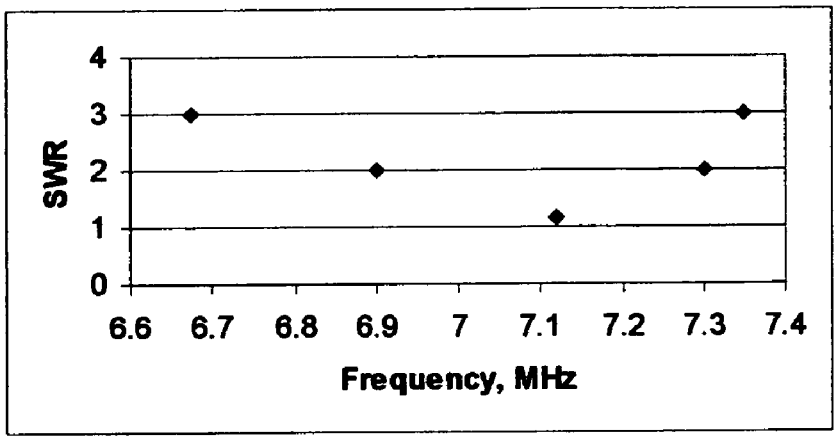
FIG. 3C shows a drawing of the 7 MHz Bandwidth vs. Standing Wave Ratio
Figure 3D:
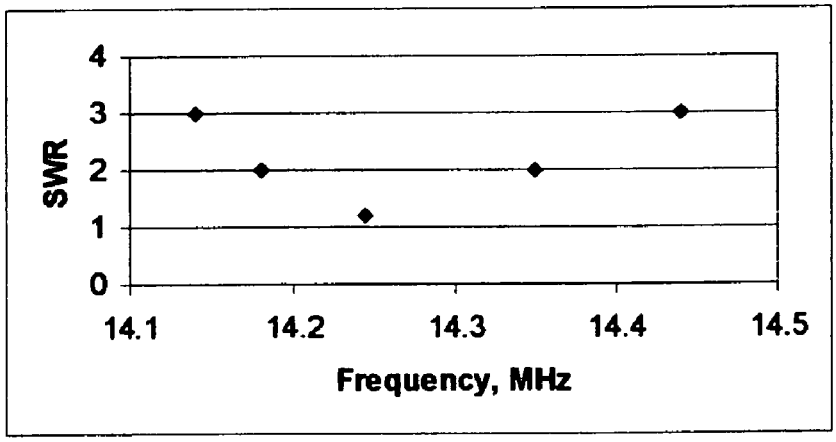
FIG. 3D shows a drawing of the 14 MHz Bandwidth vs. Standing Wave Ratio

Confirming this unique performance, FIGS. 3A, 3B and 3C show field data obtained with a laboratory grade Network Analyzer—Hewlett Packard model 8752a. Said 'figure 8' spiral dipole antenna shown in FIG. 3A was constructed for a primary resonant frequency (F) of 7.12 MHz. The measured SWR is 1:1.17 at this frequency using customary 50 ohm coax transmission line. The first harmonic frequency (2F) is 7.12×2=14.24 MHz. The measured SWR provided by said 'figure 8' spiral dipole antenna at this frequency is only 1:1.2. FIG. 3B shows this harmonic resonance SWR for the two frequencies. FIGS. 3C and 3D show this same bandwidth data with more frequency resolution for each of these two resonant frequencies.

Figure 3E:
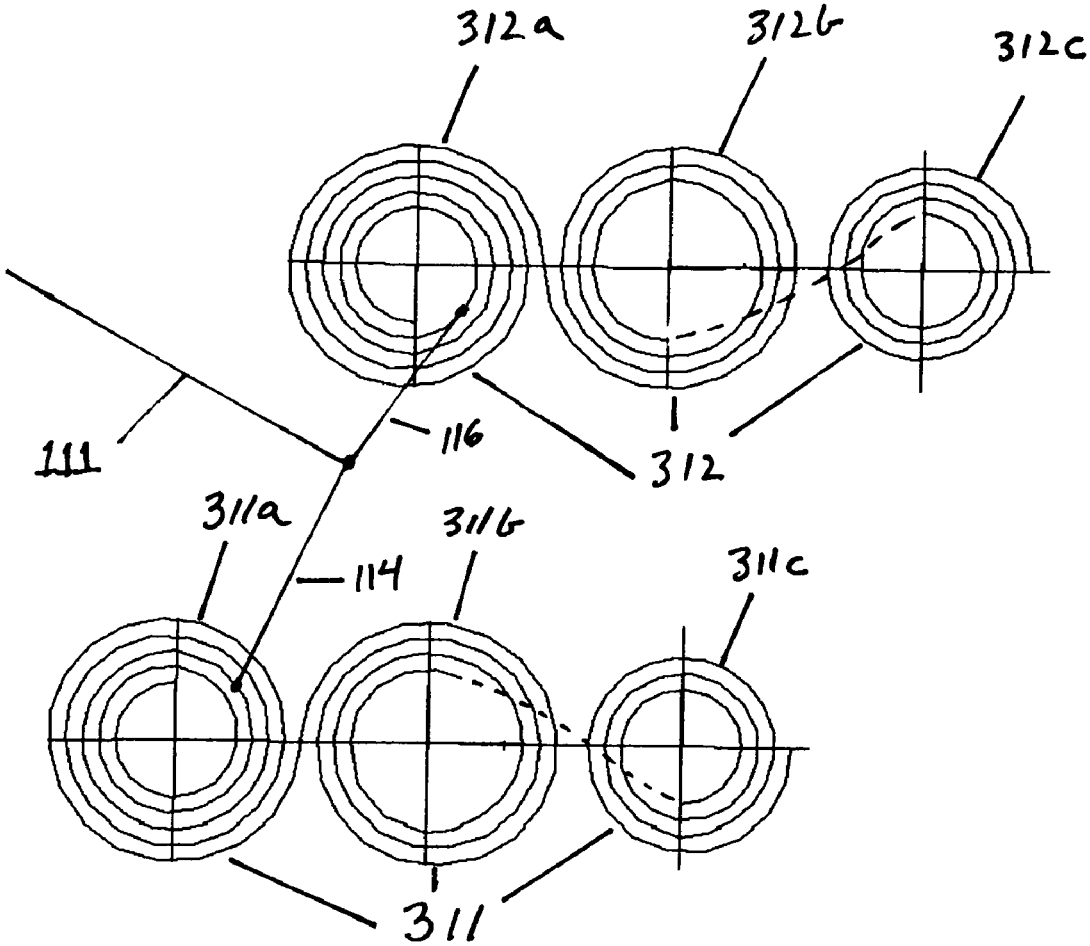
FIG. 3E shows a drawing of a three segment 'extended figure 8' spiral radiating dipole antenna

Other values of transmission line characteristic impedance in addition to 50 ohms are employable also. Impedance matching to the transmission line will be accomplished with placement location of the connecting wires to the 'figure 8' spiral radiating elements with said elements having the appropriately chosen electrical circuit parameters As a matter of fact, any number of primary frequency and multiple frequencies can be used with said 'figure 8' spiral radiating antenna as with F, $X_1F$, $X_2F$ . . . $X_nF$. For example, FIG. 3E shows a schematic drawing of an 'extended figure 8' spiral radiating dipole antenna with three spiral segments in each 'extended figure 8' spiral radiating element to get frequency resonance and impedance matching at F, $X_1F$ and $X_2F$. For clarity, only the 'extended figure 8' spiral radiating elements are shown in relation to one another with no structural components shown. The connecting wire 114 is going to the 'hot' spiral radiating element; the connecting wire 116 is going to the 'cold' spiral radiating element and 111 is the coax transmission line. Also for clarity, the dashed lines show electrical connection with the respective spiral segments.

Let's take example for frequency series: F, 1.5F, 2.3F. One would start with configuring the 'extended figure 8' spiral radiating antenna using said chosen lowest resonant frequency equation for the 'figure 8' spiral length: L8=624/F where L8 is in feet and F is the lowest resonant frequency in megacycles.

Initially for said series, the individual 'extended figure 8' radiating spirals 311 and 312 would have length L8/2. Said spiral 311 is the 'hot' spiral and said spiral 312 is the 'cold' spiral. Initial lengths of the 'extended figure 8' radiating spirals 311,312 will then be adjusted to have a different length of wire to be from 0% to 35% in ratio of 311-312/311. The adjusted length of spiral 311 will be called "311 adj" and the adjusted length of spiral 312 will be called "312adj."

Dipole antenna resonance and impedance matching to the transmission line at frequency F is generated by the combination of the entire 'extended figure 8' spirals 311adj and 312adj. Dipole resonance and impedance matching to the transmission line at frequency 1.5F is generated by the combination of the spiral segments 311*b*, 311*c* as one half of the dipole antenna which works with spiral segments 312*b*, 312*c* as the other half of the dipole antenna. Dipole resonance and impedance matching to the transmission line at frequency 2.3F is generated by the combination of the spiral segments 311*c* working with spiral segment 312*c* as the other half of the dipole antenna.

The mathematical relationships are as follows with it easier for the reader to understand by working 'backwards:'

The length of wire for spiral segment 311*c* is (F/2.3F)× 311adj;

The length of wire for spiral segment 311*b* is ((F/1.5F)× 311adj))−wire length of 311*c;*

The length of wire for spiral segment 311*a* is 311adj−(length of wire for spiral segment 312*b*+312*c*);

The length of wire for spiral segment 312*c* is (F/2.3F)× 312adj;

The length of wire for spiral segment 312*b* is ((F/1.5F)× 312adj))−wire length of 312*c;*

The length of wire for spiral segment 312*a* is 312adj−(length of wire for spiral segment 312*b*+312*c*);

Specific to this embodiment and as noted immediately above, the reader will notice that all six spiral segments of this 'extended figure 8' spiral radiating dipole antenna generate resonance and impedance matching to the transmission line at frequency F. Four spiral segments of this 'extended figure 8' spiral radiating dipole antenna generate resonance and impedance matching to the transmission line at the next higher frequency 1.5F. Two spiral segments of this 'extended figure 8' spiral radiating dipole antenna generates resonance and impedance matching to the transmission line at the highest frequency 2.3F.

The reader will notice that there are other combinations of spiral segments that will generate additional resonances and impedance matching to the transmission line, namely the pairing of spiral segments of 311*a*, 312*a* with 311*b*, 312*b;*

311*a*, 312*a* with 311*c*, 312*c*. Extending the utility of said dipole antenna even further is the fact that said additional resonate frequencies with have their own harmonic frequencies at which said antenna can operate with good performance!

The reader can see then that there are a plurality of frequency combinations that can be utilized with said "extended figure 8" spiral dipole antenna by simply adding more spiral segments in the design based upon said embodiment.

The reader will please excuse the applicant for repeating that all the spiral dipole antenna embodiments in this patent application, as this one, use wire for the spiral radiating elements. Wire is used for presenting said embodiments in a practical and easy way to comprehend the information supplied. All said spiral radiating elements can be created with any electrical conductive materials. Also, all said spiral radiating elements can be of any dimension as related to the intended antenna application for receiving and transmitting in the radio spectrum. For example, structural-size cable can be used for multi-megawatt radio stations and structures invisible to the naked eye can used as in nano technology. All said spiral radiating elements can be of approximate spiral geometry in appearance and need not have continuous curvature of that geometry. Spacing between adjacent spiral turns need not be a fixed dimension.

All said spiral radiating elements can be electrically connected to other kinds of transmission line in addition to the coax transmission line mentioned in said embodiments. All said spiral radiating elements can be electrically connected to any kind of device, in place of transmission line, used for applying radio frequency current to any and all antenna inventions in this application. Also, all said spiral radiating antennas can be operated with the plane of the spiral elements having any spatial orientation with the ground plane.

The uniqueness of the 'figure 8' and 'extended figure 8' spiral radiating element performance permits many other forms and dimension of construction. That is, said spiral radiating elements can be downsized for miniaturization for implementation in integrated circuit technology. Said spiral radiating elements can be made with very compact dimensions using very small electrical conductor dimension—that conductor being either small diameter wire, IC traces or printed conductive material, for example. In such case, said spiral radiating elements would be made from integrated circuit conductive traces and supported with of suitable insulating material as commonly used In such technology. Said spiral radiating elements can also be applied in a printed format upon flexible substrate. Size and dimension of said spiral elements would be determined by the operating frequency, the materials employed and the intended application for the spiral radiating dipole antenna. Even methodology using nano technology can be employed for the construction of said spiral radiating elements. Also, extraneous devices for tuning, resonance or impedance matching can be employed.

The reader will notice that the applicant has used "literary license" with the terns: 'spiral 8' and 'extended spiral 8.' "Literary license" is also used for FIG. 3F which shows a top view an embodiment of a 'spiral flower' for lack of a better word to describe this complex and compound spiral geometry.

Figure 3F:
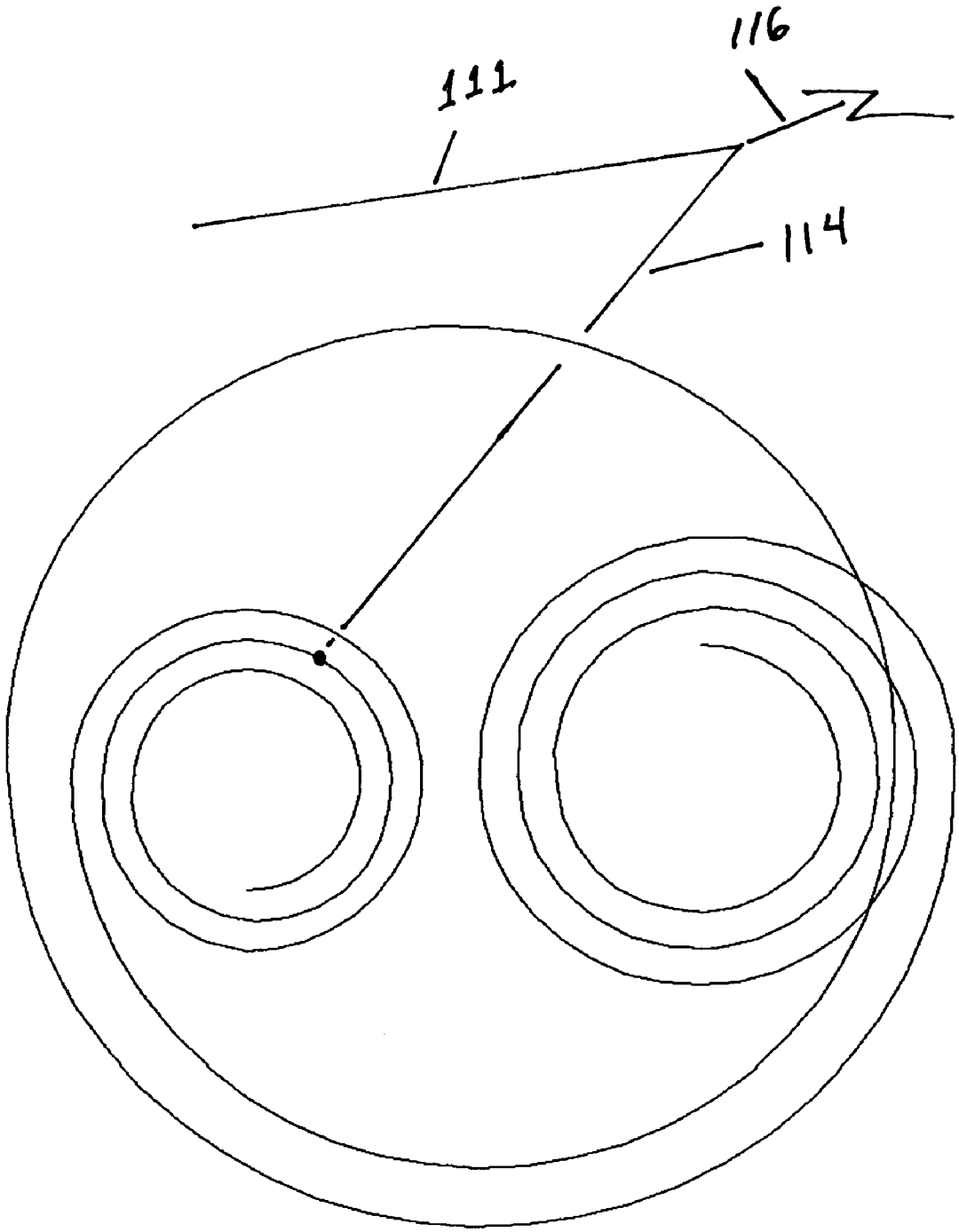
FIG. 3F shows a drawing of a compound 'spiral flower' radiating element

The intent of FIG. 3F is to show that said three spiral segments need not be arranged in a linear fashion within a spiral radiating element. Again, any number of spiral segments may be employed with said 'spiral flower' as deemed appropriate by the antenna user.

The right side of the drawing in FIG. 3F show spiral lines crossing due to the drawing being in two dimensions on the sheet of paper. In actually, said lines will not make electrical connection in actual antenna use. Also, the plane of each spiral segment can be different from the plane of any other spiral segment. For example, each conductor of any one spiral segment would be on its own substrate in an integrated circuit and separated from other spiral segments with non-conductive material and with each said spiral segment stacked one over the other in the direction perpendicular to the page of the paper. Also, said 'spiral flower' geometry of the spiral radiating element may be self-supporting as is commonly done with helix antennas with each said spiral segment separated from each other and projecting out from the paper page toward the reader.

Any and all spiral radiating element geometry need not have continuous curvature of the form. For example, other spiral-like geometries can be created with straight line segments which provide the approximate spiral-like geometric form. Also, the spacing between adjacent spiral conductors need not be the same dimension. Indeed, varying said spacing between spiral conductors provides versatility with the control of the spiral element electrical parameters as discussed previously.

Said 'figure 8', 'extended figure 8' and 'spiral flower' dipole antennas can be configured to any and all of the variations shown in any and all embodiments associated with the spiral dipole antenna embodiment shown in FIG. 1A, FIG. 1L. Additionally, said antennas can be used with balanced RF antenna current and can incorporate extraneous tuning or matching devices.

Figure 4:
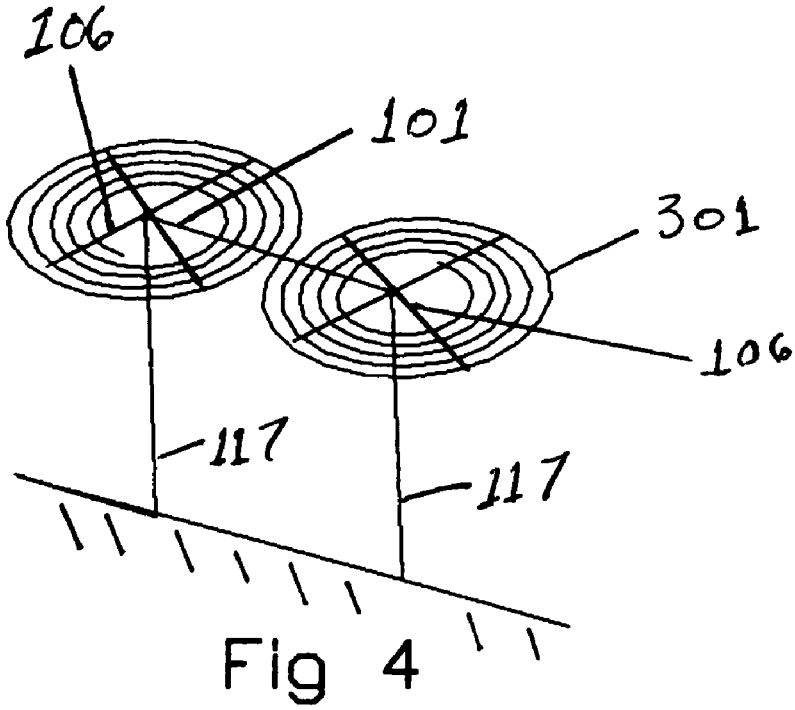
FIG. 4 shows a schematic diagram of one embodiment of the 'figure 8' spiral dipole antenna in vertical orientation with plane of radiating spiral elements parallel to the ground plane.

Using the 'figure 8' spiral for example, the isometric view in FIG. 4 shows a top view of one embodiment of said 'figure 8' spiral dipole antenna with a vertical configuration where the plane of the spiral geometry is parallel with the plane of the ground.

Figure 5:
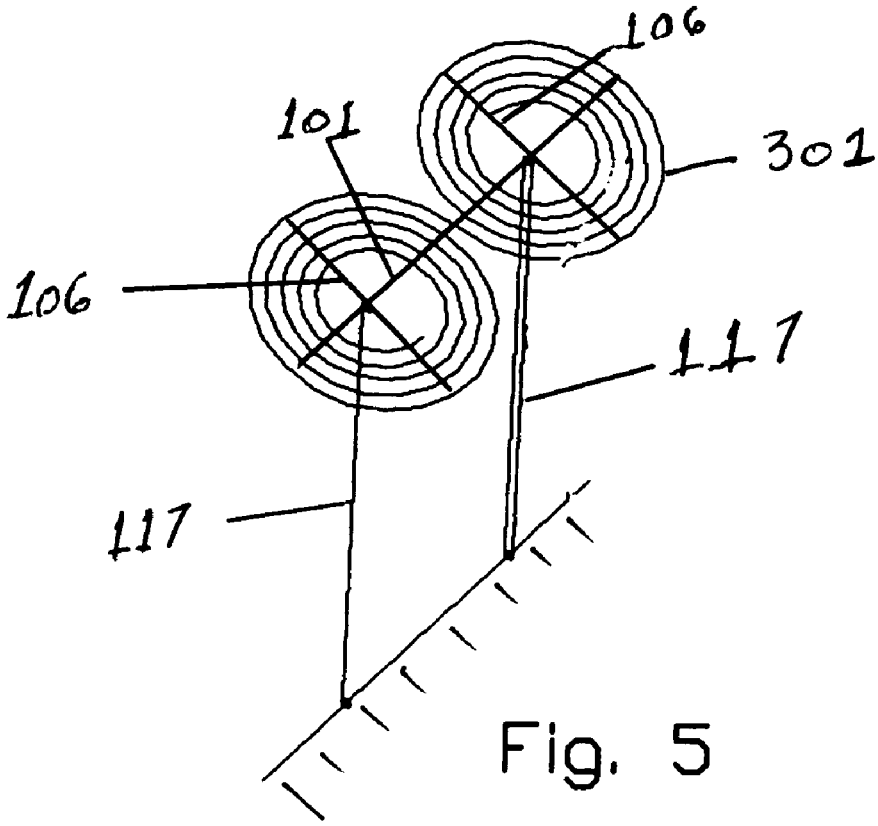
FIG. 5 shows a schematic diagram of one embodiment of the 'figure 8' spiral dipole antenna in vertical orientation with plane of radiating spiral element perpendicular to the ground plane.

As another example, FIG. 5 shows an isometric view of one embodiment of said 'figure 8' spiral dipole antenna with a vertical configuration where the plane of the spiral geometry is perpendicular with the plane with the ground. Other spiral 'figure 8' geometric plane spatial orientations with regard to ground plane are also included.

Figure 6:
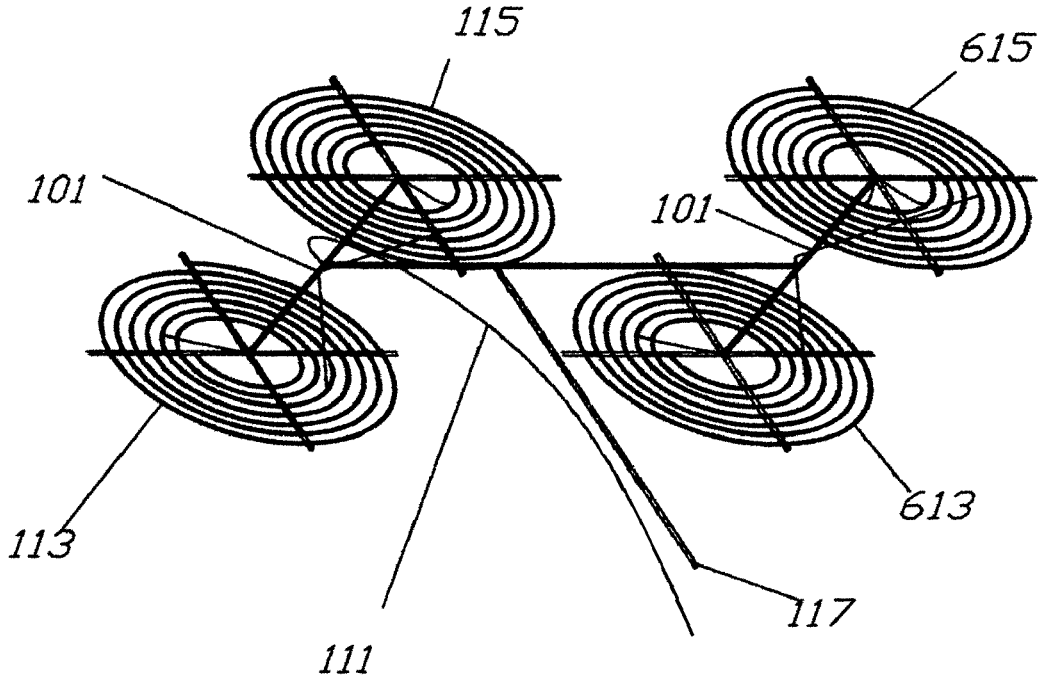
FIG. 6 shows an isometric view of one embodiment of the dipole antenna in FIG. 1A having two spiral dipoles in a Yagi configuration using one spiral dipole as the driven element and the another spiral dipole as a parasitic element.

The isometric view in FIG. 6 shows one embodiment of the spiral dipole antenna wherein the spiral radiating elements are arranged to provide enhanced beam effect and directivity of the antenna radiating pattern to a preferred geographic direction. This effect is commonly associated with a Yagi beam antenna.

Figure 7:
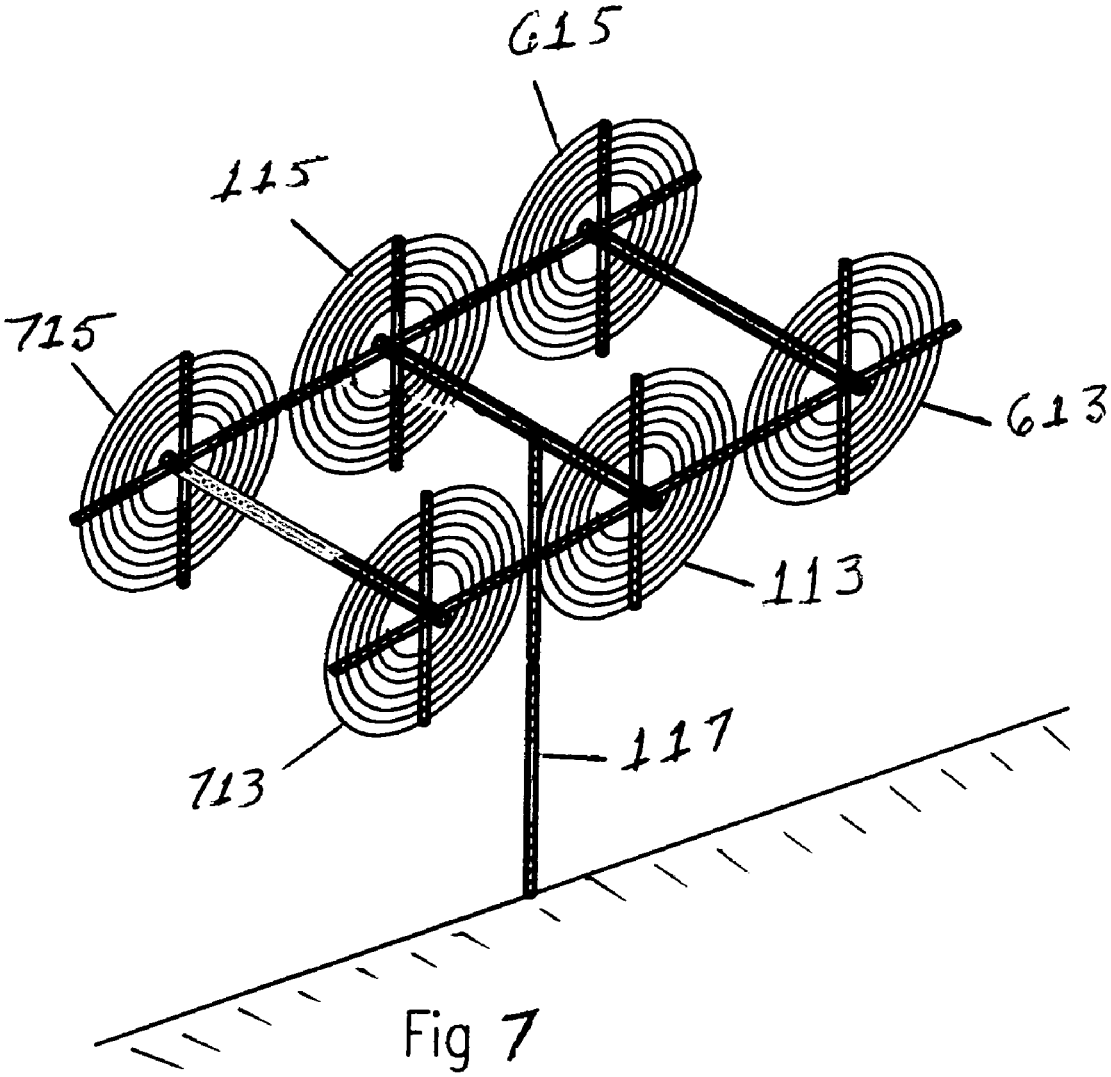
FIG. 7 shows an isometric view of one embodiment of the antenna in FIG. 1A having three spiral dipoles in a Yagi configuration for using one spiral dipole as the driven element and two parasitic elements.

This 'Yagi effect' is also available with the unbalanced and resonant spiral dipole antenna in this patent application. In the embodiment shown in FIG. 6, one spiral dipole antenna 113, 115 is becomes the driven element being fed the RF current with transmission line 111. For illustrative purposes, said antenna has the boom 101 parallel with the ground plane. The other adjacent spiral dipole antenna 613, 615 is made to act as a director element or a reflector element. Any number of said directors or reflectors is possible. The isometric view in FIG. 7 shows one embodiment as a 3 element spiral dipole beam. The driven spiral dipole element is 113, 115 with parasitic spiral dipole elements 613, 615, 713, 715 as director or reflector elements as desired by the user.

Also, this beam or "Yagi effect" is available using the 'figure 8' spiral radiating dipole antenna as the RF driven component with or without 'figure 8' spiral elements for the parasitic components. This enhanced directivity effect for all spiral radiating antennas mentioned here is also performed with the plane of antenna spiral elements in the vertical orientation with either half-wavelength or quarter wavelength configuration for any beam geometry or spiral configuration.

Moreover, all said spiral radiating elements may have any spatial orientation with the ground plane.

CONCLUSIONS, RAMIFICATIONS, AND SCOPE

Thus the reader will see that the antenna of this Invention provides highly reliable and extremely useful operating performance. The antenna of this Invention can be treated with harsh and rough handling without damage. Indeed, one has fallen from a two story residence roof—bounced twice—remained undamaged and remained still in resonance. Said antenna can withstand extended and severe outdoor weather conditions: extreme low temperature, extreme high temperatures, sustained high winds, very high wind gusts. impact from large hail contact, ice accumulation, and resists material degradation from sustained ultra-violet exposure from sunlight.

The antenna of the invention operates well on both receiving and transmitting functions across the complete radio frequency spectrum. This performance is achievable with multi-megawatt stations to applications using nano technology.

The antenna of the invention operates with full performance at a few feet above ground; it even operates well at five feet below ground level under a residence structure. Higher elevations are limited only by the means to erect and install the antenna.

The antenna requires no extraneous devices to achieve resonance and impedance matching to a transmission line. Thus, very high power levels can be employed without worry of electrical damage to such power sensitive devices or loss of power transfer to the antenna being absorbed by such extraneous devices. Maximum reception and transmission efficiency is achieved and maintained without the need of such devices. Nevertheless, such extraneous devices can also be used with said antenna as determined by the user.

The antenna enables the user a very wide selection of frequencies and choice of any combination of multiple frequencies for operation. Most important in this matter is the very low SWR and impedance matching to the transmission line at all these frequencies. The reader will notice that the 'extended figure 8' and the compound spiral referred to as "spiral flower" dipole antenna of this invention demonstrates performance not previously achieved using balanced RF dipole antenna current.

The antenna permits the user with choice of physical orientation to better receive and transmit RF communication. The orientation of the plane of each or all spiral radiating element or elements can be horizontal, vertical or any other angle with regard to ground plane. This option is important because atmospheric propagation conditions change and the user can then select the antenna orientation most suitable under such conditions.

The antenna permits the user with choice of transmission line cable. Such cables have electrical and material characteristics that change with operating frequency. This antenna can accommodate the user with the choice of cable. In addition to this customary means of feeding the antenna with radio frequency current, other kinds of electrical circuits or devices can deliver radio frequency current to this antenna. As such, transmission lines, cables and electrical circuits feeding RF energy can be impedance matched with regard to said antenna feed point impedance values.

The spiral radiating elements can be self supporting. The spiral geometry would be maintained by the strength of the material chosen for these conductors.

Although the information above contains many ideas, specifications and descriptions, these should not be construed as limiting the scope of the invention but as merely providing illustrations of some of the present embodiments of this invention. One skilled in the art would understand that the present invention may also be successfully implemented if modified. Accordingly, various modifications and changes may be made to the embodiments without departing from the broadest spirit and scope of the present invention as set forth in the claims that follow. The specification and drawings accordingly should be regarded in an illustrative rather than restrictive sense. Thus, the scope of the invention should be determined by the appended claims and their legal equivalents, rather than by descriptions and examples given previously.

What I claim is:

1. A dipole antenna, comprising: two spiral wire elements providing unbalanced radio frequency current, wherein said spiral wire elements of said antenna resonates at frequencies without the need for additional devices or components to achieve resonance, wherein said spiral wire elements of said antenna are directly connected to a transmission line, the connection between said transmission line and said spiral elements is made on any portion of said spiral wire elements, and providing impedance matching to the circuit feeding radio frequency energy to said antenna without the need for additional devices or components to achieve impedance matching, and wherein said spiral wire elements radiate a majority of the radio frequency energy.

2. The dipole antenna of claim 1, whereby said antenna structure is to be mounted outside.

3. The dipole antenna of claim 1, wherein said antenna size and dimension to have a construction determined by the frequency of operation, the choice of material composition or the choice of process for creating said spiral elements.

4. The dipole antenna of claim 1, wherein said antenna provides low standing wave ratio at a plurality of frequencies in the radio frequency spectrum.

5. The dipole antenna of claim 1, wherein said antenna provides focusing and Yagi-like directivity of said antenna radiation to a preferred geographic location.

6. The dipole antenna of claim 1, wherein one or a plurality of said spiral wire elements wind in the same or opposite radial direction with reference to the feed point of said antenna.

7. The dipole antenna of claim 1, wherein the plane of one or a plurality of said spiral wire elements be at any angle with reference to the ground plane.

8. The dipole antenna of claim 1, wherein said antenna utilize only one said spiral wire element.

9. The dipole antenna of claim 1, wherein one or a plurality of said spiral elements are self supporting.

10. The dipole antenna of claim 1, further including said spiral wire elements are balanced with radio frequency current.

11. The dipole antenna of claim 1, further including said spiral wire elements used with devices to achieve resonance, tuning, or impedance matching.

12. A dipole antenna, comprising: two spiral wire elements wherein each spiral wire element has a plurality of spiral segments made from one continuous conductor, while providing unbalanced radio frequency current, wherein the spiral wire elements of said antenna resonate on one or a plurality of frequencies, wherein the spiral wire elements are directly connected to a transmission line, and provide impedance matching to a device feeding radio frequency current to said antenna without the need for additional devices or components, wherein said antenna will operate at any combination of frequencies in the radio spectrum.

13. The dipole antenna of claim 12, wherein said antenna size and dimension to have a construction chosen by the frequency of operation, the choice of material composition, or the choice of process for creating said elements.

14. The dipole antenna of claim 12, wherein said antenna provides low standing wave ratio at a plurality of frequencies in the radio frequency spectrum.

15. The dipole antenna of claim 12, wherein said antenna provides focusing and Yagi-like directivity of said antenna radiation to a preferred geographic location.

16. The dipole antenna of claim 12, wherein said spiral wire elements wind in the same or opposite radial direction with reference to the feed point of said antenna.

17. The dipole antenna of claim 12, wherein the plane of said spiral wire elements be at any angle with reference to the ground plane.

18. The dipole antenna of claim 12, wherein said spiral wire elements are self supporting.

19. The dipole antenna of claim 12, wherein said spiral wire elements are balanced with radio frequency current.

20. The dipole antenna of claim 12, further including said spiral wire elements be used with devices to achieve resonance, tuning, or impedance matching.

* * * * *